US005911663A

United States Patent [19]

Eidson

[11] Patent Number: 5,911,663

[45] **Date of Patent: *Jun. 15, 1999**

[54] SUPPORT CLIP FOR ROOFING PANELS AND ASSOCIATED SYSTEM

[76] Inventor: Carson J. Eidson, 1910 Kennytown Rd., Greeneville, Tenn. 37745

[ * ] Notice: This patent is subject to a terminal disclaimer.

[21] Appl. No.: 08/612,057

[22] Filed: Mar. 7, 1996

Related U.S. Application Data

[63] Continuation-in-part of application No. 07/908,470, Jul. 6, 1992, Pat. No. 5,511,354, which is a continuation of application No. 07/609,176, Nov. 5, 1990, Pat. No. 5,127,205.

[51] Int. Cl.[6] ..... E04D 1/34; E04D 1/00

[52] U.S. Cl. ..... 52/520; 52/409; 52/478; 52/508; 52/544; 52/537; 52/550

[58] Field of Search ..... 52/90.2, 408, 478, 52/481.1, 508, 520, 528, 529, 545, 544, 549, 550, 552, 588.1, 698, 703, 713, 409, 410, 489.1, 537, 542, 547

[56] References Cited

U.S. PATENT DOCUMENTS

| | | | |
|---|---|---|---|
| 1,882,105 | 10/1932 | Wender . | |
| 2,150,217 | 3/1939 | Gettelman . | |
| 2,417,899 | 3/1947 | Ashman | 52/537 |
| 3,474,583 | 10/1969 | Manias | 52/408 X |
| 3,858,373 | 1/1975 | Day et al. . | |
| 3,998,019 | 12/1976 | Reinwall, Jr. . | |
| 4,193,247 | 3/1980 | Heckelsberg . | |
| 4,348,846 | 9/1982 | Bellem | 52/410 |
| 4,361,998 | 12/1982 | Ellison et al. . | |
| 4,365,453 | 12/1982 | Lowe | 52/478 |
| 4,429,503 | 2/1984 | Holliday | 52/478 X |
| 4,429,508 | 2/1984 | Sizemore . | |
| 4,494,343 | 1/1985 | Berry . | |
| 4,495,743 | 1/1985 | Ellison et al. . | |
| 4,514,952 | 5/1985 | Johansson . | |
| 4,528,789 | 7/1985 | Simpson | 52/409 X |
| 4,570,404 | 2/1986 | Knudson . | |
| 4,575,983 | 3/1986 | Lott, Jr. et al. . | |
| 4,642,961 | 2/1987 | Cruise | 52/408 |
| 4,651,493 | 3/1987 | Carey . | |
| 4,656,794 | 4/1987 | Thevenin et al. . | |
| 4,691,491 | 9/1987 | Lilley . | |
| 4,796,403 | 1/1989 | Fulton et al. . | |
| 4,807,414 | 2/1989 | Krause . | |
| 5,001,882 | 3/1991 | Watkins et al. . | |
| 5,005,323 | 4/1991 | Simpson | 52/90.2 |
| 5,088,259 | 2/1992 | Myers | 52/408 X |
| 5,222,341 | 6/1993 | Watkins et al. . | |
| 5,319,908 | 6/1994 | Van Erden et al. | 52/408 X |
| 5,367,848 | 11/1994 | McConnohle . | |
| 5,402,572 | 4/1995 | Schulte et al. . | |
| 5,584,153 | 12/1996 | Nunley et al. | 52/409 X |

OTHER PUBLICATIONS

"Total Design Flexibility With No Added Time Or Cost. That's Varco–Pruden." Brochure by Varco–Pruden Buildings, 13122/VAR.

*Primary Examiner*—Robert Canfield
*Attorney, Agent, or Firm*—Luedeka, Neely & Graham, P.C.

[57] ABSTRACT

A clip for slidably mounting new standing seam-type or rib-type metal roof panels in spaced relationship above an existing rib-type or standing seam-type roof structure includes a base member and a slide member for attachment to the base member and the new panel. The base and slide members are interfitted in a manner which permits the slide member to shift longitudinally relative to the base member. The base and slide members include interfitted sections which are U-shaped in cross section, and the interfitted sections include a cutout and detent which cooperate to limit the amount of relative shifting between the base and slide members.

27 Claims, 17 Drawing Sheets

SUPPORT CLIP FOR ROOFING PANELS AND ASSOCIATED SYSTEM

CROSS-REFERENCE TO RELATED APPLICATIONS

This is a continuation-in-part of U.S. application Ser. No. 07/908,470, filed Jul. 6, 1992, now U.S. Pat. No. 5,511,354, which is a continuation of U.S. application Ser. No. 07/609,176, filed Nov. 5, 1990, which issued Jul. 7, 1992, as U.S. Pat. No. 5,127,205. The disclosures of the '470 and '176 applications, and of the '205 patent are incorporated herein by reference.

BACKGROUND OF THE INVENTION

This invention relates generally to rib-type and standing seam-type metal roofs and relates more particularly to means for mounting metal roof panels in spaced relationship above an existing roof structure.

In a metal roof structure commonly referred to as a "rib" type, the edges of adjacent panels are placed in overlapping relationship, and the overlapped panels are secured to the structural members (purlins) underlying the panels by appropriate securing means, such as self-tapping sheet metal screws or clips. Commonly, each panel of a rib-type metal roof is elongate in form and has a plurality of parallel upstanding ribs formed therein which run lengthwise of the panel. In standing seam-type metal roof structures, raised edges of adjacent panels are placed against one another and bent downwardly to provide the standing seam. The panels of both types of roof structures, being metal, are known to experience dimensional changes, i.e., expansion and contraction, due to temperature variations to which the panels are exposed. In order to alleviate stresses and strains spawned by the expansion and contraction of the panels, devices or clips may be interposed between the panels of the roof and the underlying structural members for accommodating longitudinal dimensional changes in the panels. One such device for rib-type roofs is shown and described in U.S. Pat. No. 4,429,508, and one such device for standing seam-type roofs is described in U.S. Pat. No. 4,575,983.

It is an object of the present invention to provide an improved device for mounting roof structures over existing roof structures.

Another object of the present invention is to provide such a device which is uncomplicated in construction and effective in operation.

Still another object of the present invention is to provide such a device which is well-suited for supporting a standing seam type roofing panel above an existing rib-type roof.

Yet another object of the present invention is to provide means for supporting a rib-type roofing panel above an existing standing rib-type roof.

Another object of the present invention is to provide such a device which is well-suited for supporting a standing seam-type roofing panel above an existing standing seam-type roof.

A further object of the present invention is to provide a roofing system which incorporates such a device.

SUMMARY OF THE INVENTION

The present invention provides systems for re-roofing wherein new ribbed or standing seam roof structures may be installed over existing ribbed or standing seam roof structures without removing the existing roof. This greatly simplifies and reduces the cost of re-roofing since it is not necessary to remove the old roof. This not only save money and simplifies the task, it also helps to avoid damage to the underlying building structure which may occur during removal of the old roof and it is believed to be safer because the risk of falling through an open space is reduced. In addition, the resulting roof structure provided by the combination of the old and new roofing layers has advantages over conventional single layer roofs. For example, the air space between the two layers helps to reduce thermal transfer through the roof and thus provides an insulating effect which is advantageous to reduce heating and cooling costs.

In one aspect directed to re-roofing applications wherein a standing seam roof is installed over an existing ribbed roof, the present invention provides a roof system which includes a first layer of interconnected ribbed roof panels having longitudinal ribs thereon and a second layer of standing seam roof panels overlying the ribbed roof panels, with adjacent ones of the standing seam panels interconnected along a standing seam. Structure is provided for movably supporting the layer of standing seam roof panels above the layer of ribbed panels to accommodate longitudinal movement of the layers relative to one another.

In another aspect directed to re-roofing applications wherein a standing seam roof is installed over an existing standing seam roof, the present invention provides a roof structure including first and second layers of standing seam roof panels, wherein adjacent ones of the standing seam panels of each layer are interconnected along standing seams. Structure is provided for movably supporting the second layer of standing seam roof panels above the first layer of standing seam roof panels to accommodate longitudinal movement of the layers relative to one another.

In yet another embodiment directed to re-foofing, the invention provides a roof system which includes a building structure, a first layer of contiguous interconnected ribbed roof panels positioned in an overlying relationship to and connected to the building structure, structure for connecting the first layer of ribbed roof panels to the building structure; a second layer of contiguous interconnected ribbed roof panels positioned above the first layer of ribbed roof panels with the ribs of the second layer of standing seam panels generally vertically aligned with the ribs of the first layer of ribbed panels, and structure for connecting the second layer of ribbed panels to the first layer of ribbed panels in spaced relation.

BRIEF DESCRIPTION OF THE DRAWINGS

The above and other features, aspects and advantages of the invention and its various embodiments will now be described in greater detail in conjunction with the accompanying drawings in which.

DETAILED DESCRIPTION OF THE ILLUSTRATED EMBODIMENTS

Figure 1:
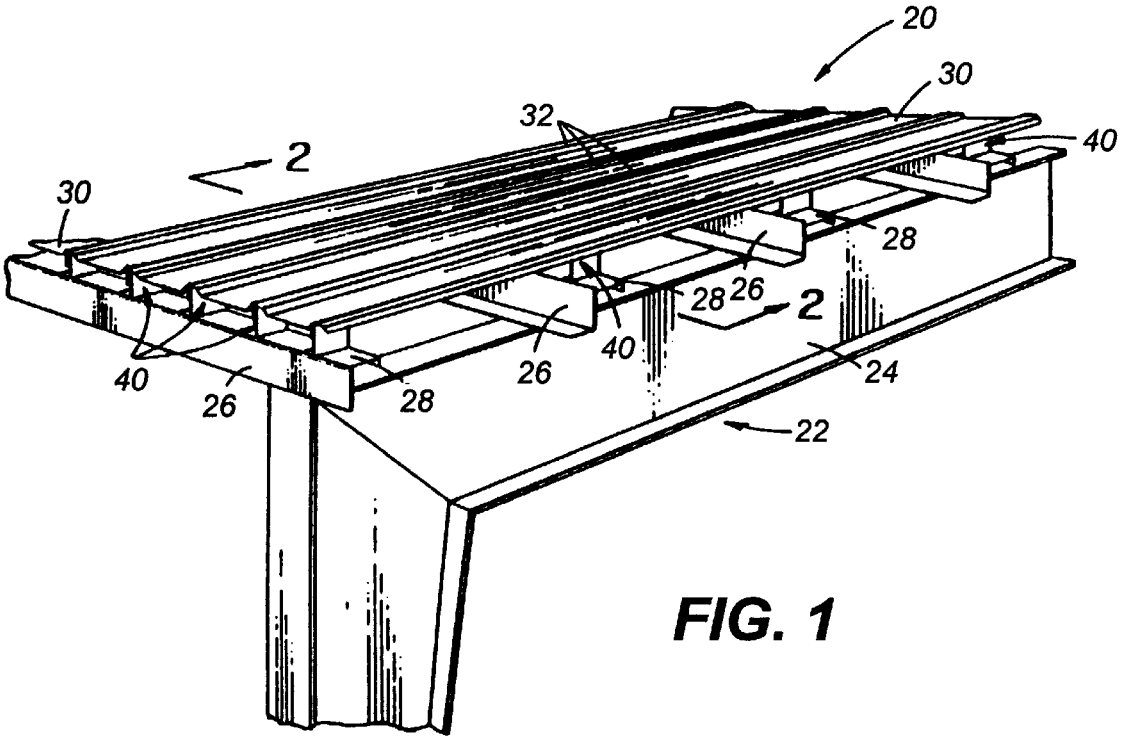
FIG. 1 is a fragmentary perspective view of a ribbed roof structure within which an embodiment of a clip is incorporated.

Turning now to the drawings in greater detail and considering first FIG. 1, there is illustrated a rib-type roof structure 20 supported atop a structural frame 22 of a metal building. The frame 22 includes rafters in the form of I-beams 24 which extend generally upwardly at an angle from the eave of the building to the peak of the roof. Supported by the I-beams 24 are roof purlins 26 which are disposed in spaced parallel relation with one another and which extend horizontally across the top of the I-beams 24. Each roof purlin 26 is in the form of a steel channel having a bottom portion which is attached to the I-beams 24 across which the purlins 26 extend and having a top portion defining a flat upper surface 28.

Figure 2:
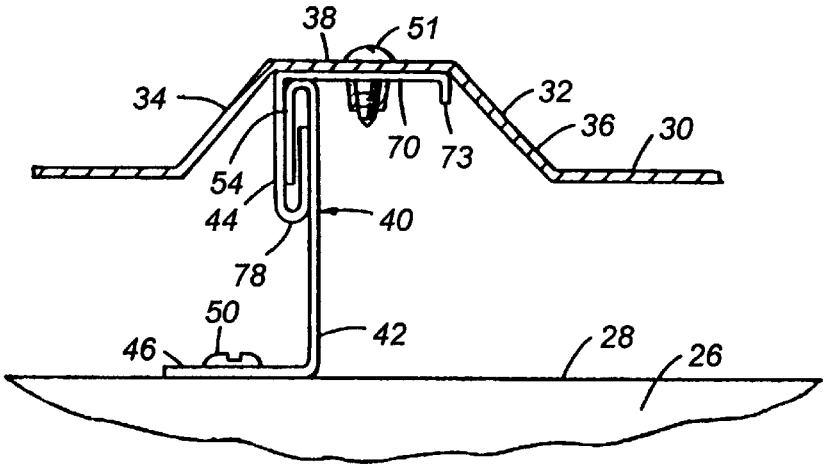
FIG. 2 is a fragmentary cross-sectional view taken along line 2—2 of FIG. 1.

The roof structure 20 includes a plurality of rectangular panels 30 arranged in overlapping and side-by-side relationship across the purlins 26. Each panel 30 is elongate in form with two relatively short ends, two relatively lengthy sides extending between the ends and a plurality of parallel ribs 32 extending longitudinally of the panel 30 between the ends thereof. As best shown in FIG. 2, each rib 32 is formed with two opposite sloped sidewalls 34, 36 and a flat pan section 38 which extends between the sidewalls 34, 36 adjacent the top thereof. When the panels 30 are installed upon a roof, at least one rib 32 of one panel 30 is placed so as to matingly overlap at least one rib 32 of an adjacent panel 30.

Figure 3:
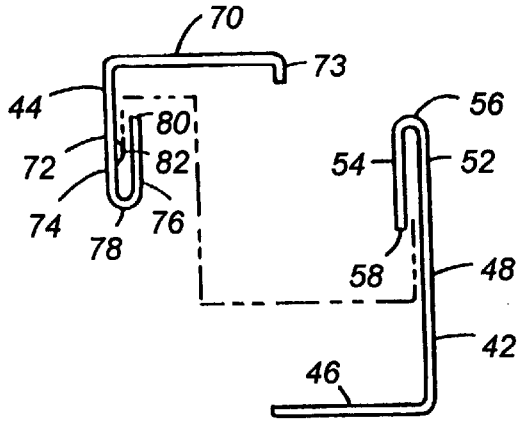
FIG. 3 is an end view of the clip illustrated in FIG. 2, shown exploded.

The ribbed panels 30 are supported atop the purlins 26 by a plurality of clips 40 interposed between the panels 30 and the purlins 26. As best shown in FIG. 3, each clip 40 includes a base member 42 which is attachable to an underlying purlin 26 and a slide member 44 which is attachable to a roof panel 30. As is apparent herein, the base and slide members 42, 44 are interfitted in a manner which permits the slide member 44 to shift longitudinally with respect to the base member 42. When installed in the roof structure 20 beneath the panels 30, the clips 40 permit the roof panels 30 to shift longitudinally with respect to the purlins 26 and thereby relieve stresses and strains within the structure 20 which are a consequence of the expansion or contraction of the panels 30 due to variations in the atmospheric temperature to which the panels 30 are exposed.

Figure 4:
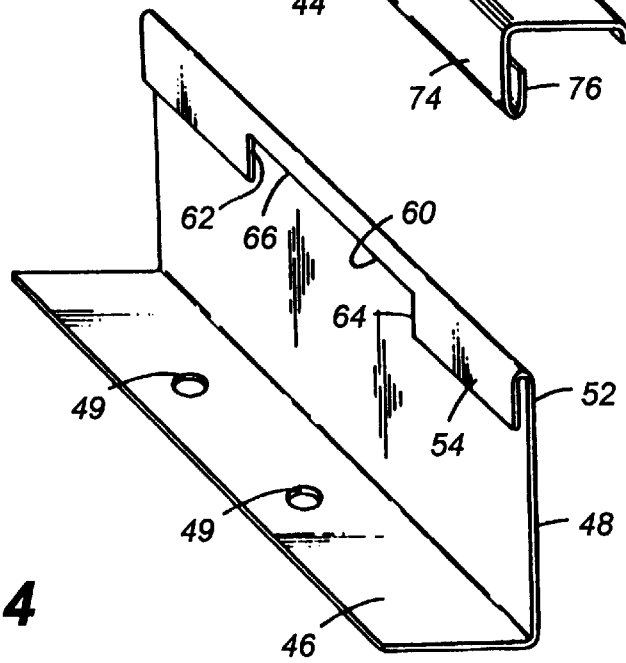
FIG. 4 is a perspective view of one component of the FIG. 2 clip as seen generally from the left in FIG. 3.

With reference to FIGS. 2–4, the base member 42 includes an elongated lower section 46 which is attachable to an underlying purlin 26 and an upstanding section 48 which extends upwardly from the lower section 46. The lower section 46 is flat so as to stably overlie the top surface 28 of the underlying purlin 26 and includes a pair of apertures 49 through which screws 50 (only one shown in FIG. 2) may be inserted for securement of the base member 42 in a stationary relationship with the underlying purlin 26.

As best shown in FIG. 3, the upstanding section 48 includes an upper portion which is generally U-shaped in cross-section having two legs 52, 54 joined at a bend 56 and arranged in such a relationship with the lower section 46 so that its U opens downwardly toward the lower section 46. One leg 52 is joined directly to the lower section 46 along one side thereof, and the other leg 54 depends downwardly from the bend 56 so that the free end of the leg 54, indicated at 58, is spaced above the lower section 46. As shown in FIG. 4, each leg 52 or 54 extends the full length of the lower section 46. One leg 54 of the upstanding section 48 includes a cutout 60 which opens downwardly as shown in FIG. 4. In the depicted section 48, the cutout 60 is centered between longitudinal and opposite ends of the section 48 and has two opposing parallel sides 62, 64 and a linear edge 66 extending between the sides 62, 64.

Figure 5:
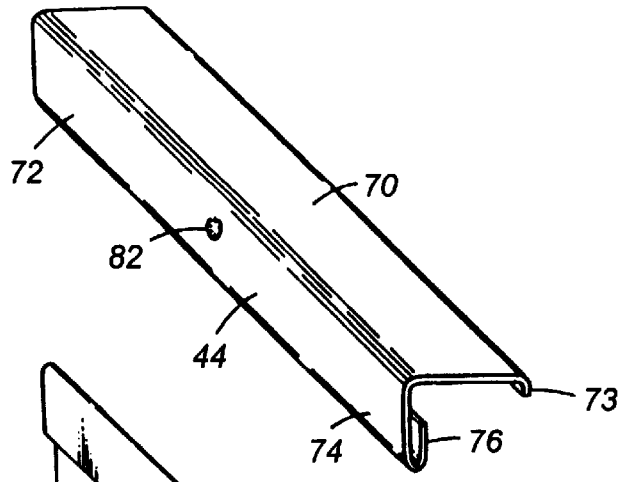
FIG. 5 is a perspective view of the other component of the FIG. 2 clip as seen generally from the left in FIG. 3.

With reference to FIGS. 2, 3 and 5, the slide member 44 includes an elongated upper section 70 which is attachable to a roof panel 30 positioned upon the clip 40 and a depending section 72 which depends downwardly from the upper section 70 along the length thereof. The upper section 70 is relatively narrow as measured between its longitudinally oriented side edges for acceptance between the sidewalls 34, 36 of the panel rib 32 and has a flat upper surface for flatly and stably engaging the underside of the flat pan 38. In the depicted clip 40, the upper section 70 is sized to be nestingly received between the sidewalls 34, 36 when engaging the flat or land 38 of the ribs, as shown in FIG. 2, and is secured to the flat 38 with self-tapping screws 51 (only one shown in FIG. 2). For rigidifying the upper section 70 and assisting in establishing a nesting relationship with the rib, a downwardly-depending lip 73 is formed along one side edge of the upper section 70 opposite the depending section 72.

As best viewed in FIG. 3, the depending section 72 includes a portion which is generally U-shaped in cross section having two legs 74, 76 joined at a bend 78 and arranged in such a relationship with the upper section 70 so that its U opens upwardly toward the upper section 70. One leg 74 is joined directly to the upper section 70 along one side thereof, and the other leg 76 extends upwardly from the bend 78 so that the free end of the leg 76, indicated at 80, is spaced from the upper section 70. As shown in FIG. 5, each leg 74 or 76 extends the full length of the upper section 70.

The upstanding section 48 and depending section 72 are proportioned and spaced apart to fittingly and slidably accept a corresponding leg 54 or 76 of the other section 72 or 48. Accordingly, the opening provided by each U is slightly greater in width than the thickness of the leg 54 or 76 which the U is adapted to accept. When assembling the base member 42 and the slide member 44, the legs 54 and 76 are inserted endwise, i.e., longitudinally, into the opening provided by the U of the other section 72 or 48. With the slide member 44 interfitted with the base member 52 in the manner illustrated in FIG. 2, the leg 54 is captured between the upper section 70 and the bend 78 of the slide member 44 to prevent the base and slide members 42, 44 from coming apart by moving the Us of the sections 72, 48 directly apart, or vertically apart as viewed in FIG. 2.

Once the base and sliding members 42, 44 are interfitted in the manner illustrated in FIG. 2, a detent 82 (FIG. 5) is formed in one leg 74 of the depending section 72 so as to protrude into the cutout 60 of the leg 54 of the upstanding section 52. The detent 82 is located substantially midway along the length of the slide member 44 and cooperates with the cutout 60 to limit the longitudinal movement of the slide member 44 relative to the base member 42. More specifically, if the slide member 44 is moved endwise relative to the base member 42 in one longitudinal direction, the detent 82 abuts one side 62 or 64 of the cutout 60 to prevent further lengthwise movement of the slide member 44 in that one direction. Similarly, if the slide member 44 is moved endwise relative to the base member 42 in the other longitudinal direction, the detent 82 abuts the other side 64 or 62 of the cut-out 60 to prevent further lengthwise movement of the slide member 44 in that other direction.

It follows from the foregoing that with the base member 42 fixedly secured to a purlin 26 and the slide member 44 fixedly secured to a roof panel 30 in the manner illustrated in FIG. 2, the roof panel 30 is permitted to shift longitudinally with respect to the purlin 26 to accommodate a lengthwise dimensional change in the panel 30. Therefore, the clips 40 reduce the likelihood that the roof structure 20 will be exposed to stresses and strains which may otherwise result from lengthwise expansion or contraction of an associated panel 30.

Figure 6:
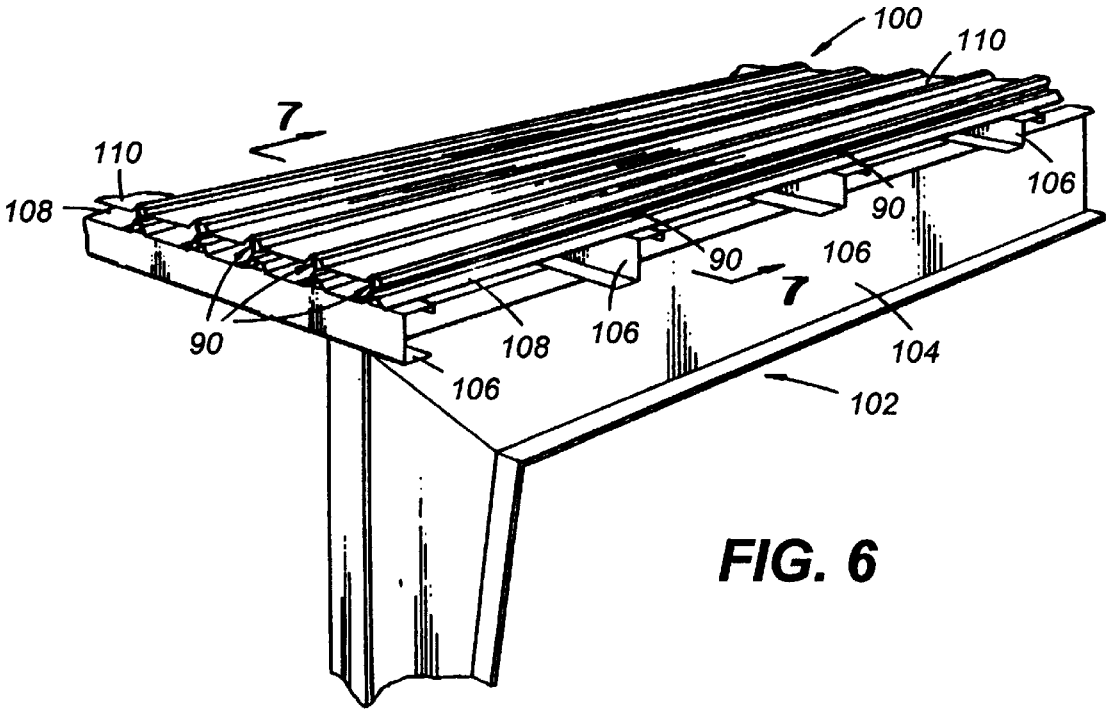
FIG. 6 is a fragmentary perspective view of a roof structure within which another embodiment of a clip is incorporated. The clip of this embodiment is shown utilized for installation of a rib-type roof structure over a rib-type roof structure.
Figure 7:
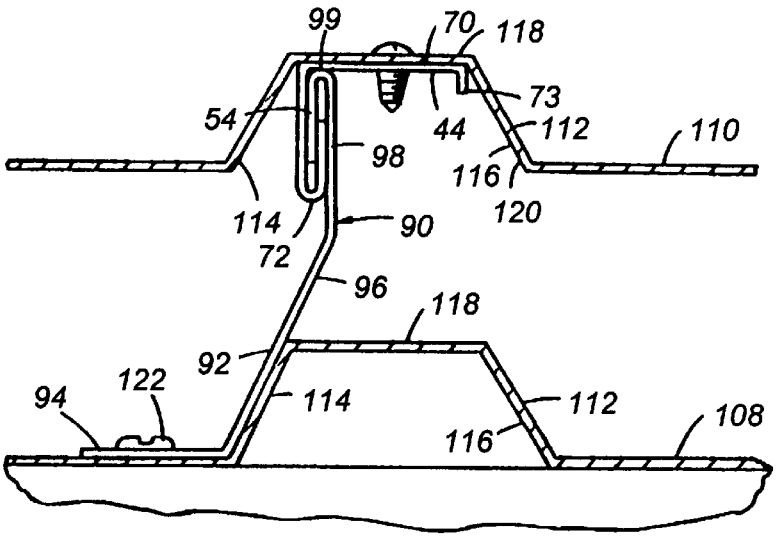
FIG. 7 is a fragmentary cross-sectional view taken along line 7—7 of FIG. 6.
Figure 8:
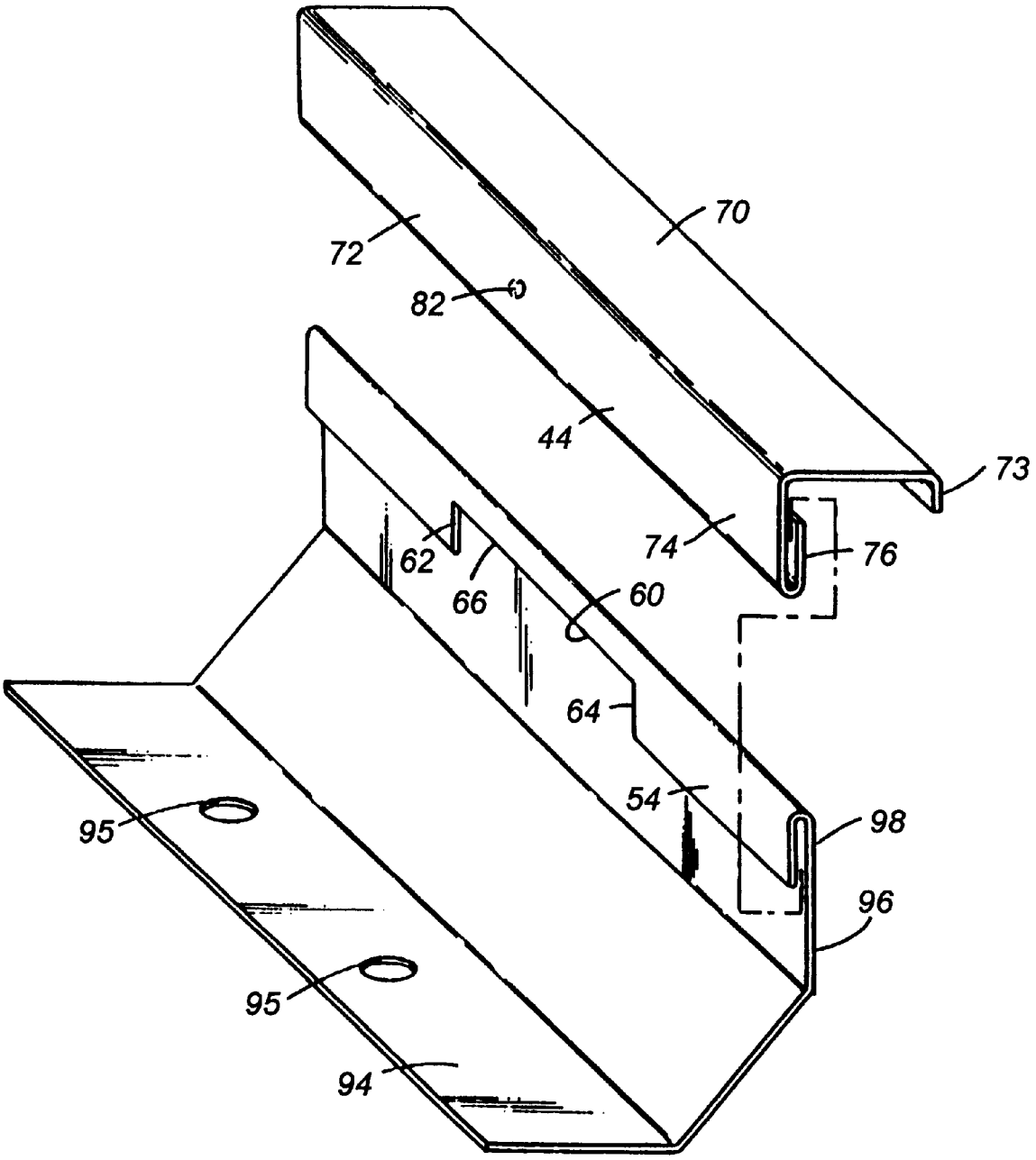
FIG. 8 is a perspective view of the clip of FIG. 7, shown exploded.

With reference to FIGS. 6–8, there is illustrated an alternative embodiment of a clip 90 embodying features of the present invention shown utilized in a rib-type roof structure 100. The roof structure 100 is supported atop a structural frame 102 including I-beam rafters 104 and a plurality of purlins 106 disposed in spaced parallel relation across the I-beams 104. Included in the structure 100 is a first, or lower, layer of panels 108 and a second, or upper layer of panels 110 disposed above the first layer of panels 108. The panels 108 and 110 may be identical in construction and each may include a plurality of ribs 112 extending longitudinally of the panel. As best shown in FIG. 7, each rib 112 may be formed with two opposing sloped sidewalls 114, 116 and a flat or land section 118 which extends between the sidewalls 114, 116 adjacent the top thereof. Collectively, the sidewalls 114, 116 and flat section 118 provide a downwardly opening recess 120 which runs along the underside of its panel 108 or 110. Each panel 108 or 110 partially overlaps an adjacent panel 108 or 110 in its corresponding layer so that at least one rib 112 of one panel 108 or 110 matingly overlaps at least one rib 112 of an adjacent panel 108 or 110 to provide an overall uniform arrangement of continuous, parallel, evenly spaced-apart ribs extending across the width of the structure 100.

In the depicted roof structure 100, a plurality of clips 90 are disposed between the lower layer of panels 108 and the upper layer of panels 110 for supporting the panels 108 and 110 in a spaced parallel relationship. Each clip 90 includes a base member 92 and a slide member 44 which is interfitted with the base member 92 in a manner which permits the slide member 44 to shift longitudinally with respect to the base member 92. In this embodiment, the slide member 44 of each clip 90 of FIGS. 6–8 is identical to that of the slide member 44 of the clip 40 of FIGS. 1–5 and, accordingly, the slide member components bear the same reference numerals. The upper section 70 of the slide member 44 is thus sized to be nestingly received by the downwardly-opening recess 116 provided by the rib 112 of a panel 110, as shown in FIG. 7.

The base member 92 includes an elongated lower section 94 and an elongated upstanding section 96 extending generally upwardly from the lower section 94. The lower section 94 is flat for stably overlying the horizontal span or low pan between adjacent ribs 112 of the lower panels 108, preferably above a purlin 106, and includes a pair of apertures 95 for securement of the base member 92 to the underlying purlin 106 with self-threading screws 122 (only one shown in FIG. 7) extending through the lower panels 108. The upstanding section 96 includes a U-shaped upper portion having two legs 98, 54 joined at a bend 99. One leg 54 of the clip 90 of FIGS. 6–8 is identical to the leg 54 of the clip 40 of FIGS. 1–5, and accordingly, its components and cut-out bear the same reference numerals.

It is a feature of the clip 90 that the leg 98 of its base member 92 includes a lower portion which is shaped and disposed at an angle in relation to the shape of a sidewall 114 or 116 of a rib 112 of a panel 108 such that when the base member 92 is secured atop a panel 108 as shown in FIG. 7, its upstanding section 96 engagably lies against the sidewall 114 or 116. In the depicted structure 100, each sidewall 114, 116 of the rib 116 is sloped at about a fifty degree angle with respect to the low pan between adjacent ribs 112, and the lower portion of the leg 98 of the upstanding section 96 is sloped accordingly. Therefore, a sufficient amount of the area of the sidewall 114 or 116 engages the sloped portion of the leg 98 when the base member 92 is secured adjacent the rib 112 to assist in supporting the section 96 in its upstanding condition.

It is also a feature of each clip 90 that the ribs 112 of the lower panels 108 and the upper panels 110 may be disposed in approximate vertical registry. To this end, the upper section 44 of each clip 90 is disposed in such a positional relationship relative to the base member 92 so that when the lower section 94 of the base member 92 is secured to the roof panel 108 with the lower portion of the leg 98 disposed against the rib sidewall 114 of the lower panel 108, and with the upper section 70 accepted by the downwardly-opening recess 120 provided by the rib 112 of the panel 110, the ribs 112 of the lower and upper panels 108 and 110 are in approximate vertical registry.

With the ribs 112 of the lower and upper panels 108, 110 in vertical registry, the slide member 44 of each clip 90 is disposed generally vertically above the rib 112 of the lower panel 108 and the base member 92 of each clip 90 is disposed close to one side of the rib 112 of the lower panel 108. This arrangement transmits the weight of the upper panel 110 to the lower panel 108 to locations adjacent the ribs 112 of the panel 108 and maintains a relatively uniform spacing, i.e. air gap, between the upper and lower panels 108, 110. This air gap provides an insulative layer between the upper and lower panel layers and is advantageous in this respect. Also, the space that is provided readily accommodates a layer of insulation which need not be significantly compressed to retain a desired effective thickness, even at the locations where the panels are joined to the understructure. In addition, the clips 90 accommodate an efficient installation of a new roof system including an upper layer of panels 110 atop an existing roof system including a layer of panels 108 to avoid the cost and inconvenience associated with the removal of the existing roof prior to installation of the new roof system.

An advantage associated with the illustrated embodiments of the invention is that the clips 40 and 90 may be disposed in alternating rows facing in opposite directions along adjacent purlins 106 or along and above adjacent purlins underlying an existing set of panels 108. The use of such alternatingly directed rows of clips 40 and 90 provides an exceedingly stable arrangement against sidewise movement of the panels 30 or 110 relative to the underlying structure (as opposed to the permitted longitudinal movement) so that collapse of the panels 30 or 110 caused by a force directed generally parallel to the plane of the roof is substantially prevented. The clips 40 and 90 may also be alternately disposed in opposite directions with a single row of clips.

A further advantage of the clips 40 and 90 of the illustrated embodiments is that the supported roof panel is attached to the clips along the top of the ribs. No apertures need to be made in the roof panels at the relatively low pan portion of the panels in the horizontal span between adjacent ribs. Thus, water accumulation and consequent leakage at the point of attachment between the roof panels and the clips 40 and 90 is virtually eliminated.

The structure of the clips 40 and 90 of the illustrated embodiments is also exceedingly simple so that manufacturing costs are kept low. Also, no special skill or training is required for installation of the clips which can be completed in an expedient manner with standard tools and equipment. Overall, the clips of the invention contribute to a roof structure that combines functional improvements and significant cost reductions for a material advance in the art.

It is also noted that in some cases it may be desireable and economical to use a clip construction in which the clip is a solid piece rather than two pieces. As will be appreciated, the panels which form the standing seam are movable relative to the clip such that movement may occur between the overlapping panels and the clip at the structural interface between the clip and the panels.

Figure 9:
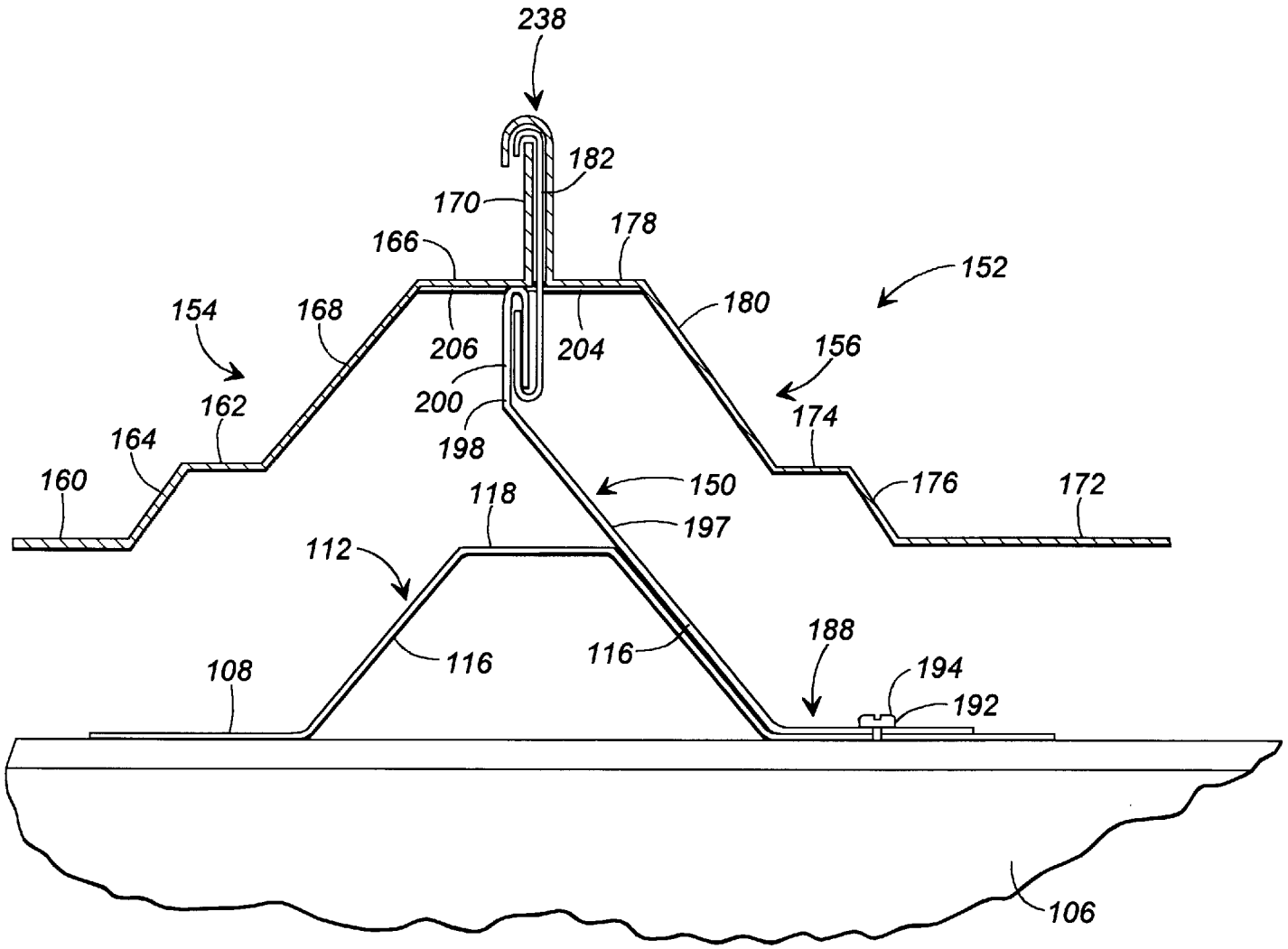
FIG. 9 is a fragmentary cross-sectional view of a roof structure within which another embodiment of a clip is incorporated. The clip of this embodiment is shown utilized for installation of a standing seam-type roof structure over a rib-type roof structure.
Figure 10:
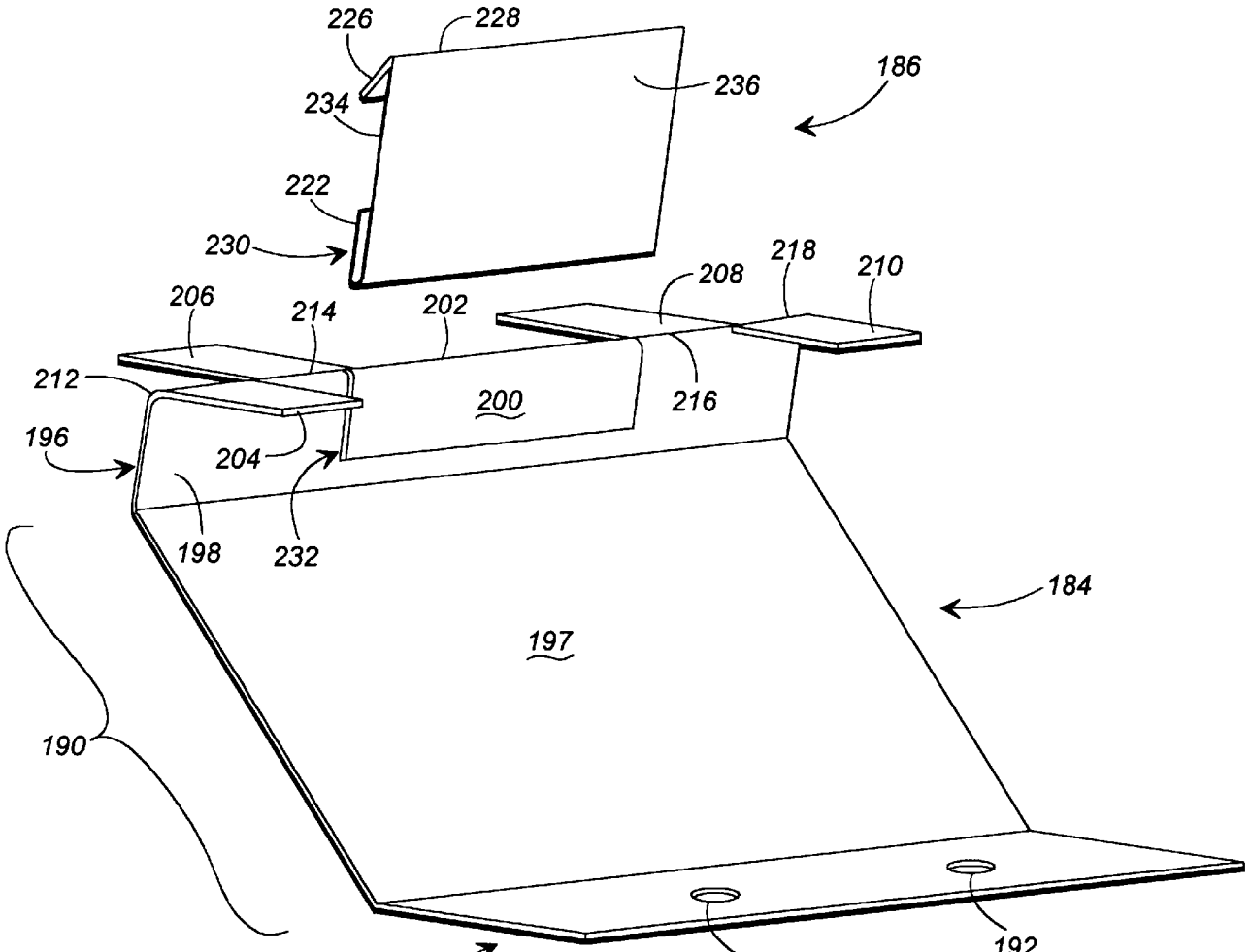
FIG. 10 is a perspective view of the clip of FIG. 9, shown exploded.

With reference to FIGS. 9 and 10, there is shown another embodiment of a clip 150 embodying features of the present invention utilized to provide a roof structure 152. In the roof structure 152, a standing seam-type roof provided by an upper layer of standing seam-type roof panels 154, 156 is mounted by use of a plurality of clips 150 in spaced relationship above an existing rib-type roof, such as the roof structure provided by lower rib-type panels 108 described previously in connection with FIG. 7.

The panel 154 may be any of the commercially available standing seam roof designs, and in the depicted embodiment is a standing seam-type roof panel available from Varco-Pruden Buildings of Memphis, Tenn. under the tradename SSR, and includes horizontal sections 160, 162 connected by a sloped section 164 and a horizontal section 166 connected to horizonal section 162 by a sloped section 168. A vertical section 170 extends upwardly from the edge of horizontal section 166 opposite the sloped section 168 to provide a raised edge which extends the length of the panel. The panel 156 may be identical in construction to the panel 154 and includes horizontal sections 172, 174 connected by a sloped section 176 and a horizontal section 178 connected to horizonal section 174 by a sloped section 180. A vertical section 182 extends upwardly from the edge of horizontal section 178 opposite the sloped section 180 to provide a raised edge, except, the vertical section 182 is preferably of greater height than the vertical section 170 of the roof panel 154 so that the section 182 has sufficient length to be folded over the section 170 of the clip 150 to provide the standing seam, as explained in greater detail below.

In a preferred embodiment, a plurality of the clips 150 are disposed between the lower rib-type panels 108 and the upper standing seam-type panels 154, 156 in a re-roofing type application for supporting the standing seam-type panels 154, 156 in spaced relationship above the panels 108. With reference to FIG. 10, each clip 150 includes a base member 184 and a slide member 186 which is interfitted with the base member 184 in a manner which permits the slide member 186 to shift longitudinally with respect to the base member 184.

The base member 184 of the clip 150 includes a lower section 188 and an elongated upstanding section 190 extending generally upwardly from the lower section 188. The lower section 188 is flat for stably overlying the horizontal span between adjacent ribs 112 of the lower panels 108 and includes apertures, such as apertures 192 for securement of the base member 184 to the underlying support, such as to underlying purlin 106 with self threading screws 194 extending through the lower panels 108.

The upstanding section 190 of the clip 150 includes an upper portion 196 and a lower portion 197. The lower portion 197 extends upwardly at an angle from the lower portion 188 of the base member 184. The upper portion 196 includes vertical sections 198 and 200 joined at a bend 202 and horizontal sections 204, 206, 208 and 210 joined to the vertical section 198 at bends 212, 214, 216 and 218, respectively.

The lower portion 197 of the upstanding section 190 is similar in shape and configuration to the leg 98 of the clip 90 (discussed previously in connection with FIG. 7) and is shaped and disposed at an angle with respect to the sidewall 114 or 116 of a rib 112 of a panel 108 so that when the base member 184 is secured atop a panel 108 as shown in FIG.

9, its upstanding section 190 engagably lies against the sidewall 114 or 116 and enables the standing seam provided by the panels 154, 156 (explained more fully below) to be in vertical registry with the center of the pan section 118 of the underlying panel 108.

The slide member 186 includes vertical sections 220 and 222 joined at bend 224 and an angled section 226 joined to the other end of the vertical section 222 at bend 228. The vertical sections 220 and 222 face one another and are spaced-apart to provide a U-shaped channel 230 which is configured to be slidingly received within a corresponding U-shaped channel 232 provided by vertical sections 198 and 200 of the upper portion 196.

Assembly of the clip is uncomplicated and may be accomplished by positioning the vertical section 228 of the slide member between sections 198 and 200 of the base member so that the section 228 extends into the channel 232 and the section 200 extends in to the channel 230. A protrusion and corresponding detent (not shown) for receiving the detent are preferably provided midway along the length of the sections 200 and 228, respectively, to facilitate maintenance of the clip in the assembled configuration during transportation and installation of the clip. Longitudinal travel of the slide member relative to the base member when the clip is installed is limited by horizontal sections 206 and 208, as explained more fully below.

Installation of the roof structure 152 may be accomplished by securing a plurality of the assembled clips 150 to the underlying rib-type panels 108 by use of screws 194 and thereafter installing a standing seam roof by mounting the standing seam roof panels 154, 156 to the clips. Preferably, the panels 154 and 156 are positioned adjacent to one another on opposite sides of the clip 150 so that the horizontal sections of the panels 154, 156 rest on the horizontal sections of the base member 184 of the clip 150 and the vertical sections of the panels, i.e., the raised edges, are adjacent one another with the slide member 186 sandwiched therebetween.

For example, as shown in FIG. 9, horizontal section 166 of the panel 154 rests on and is supported by horizontal sections 206 and 208 of the clip, horizontal section 178 of the panel 156 rests on and is supported by horizontal sections 204 and 210 of the clip 150, vertical section 170 of the panel 154 abuts side 234 of vertical section 220 of the sliding member immediately below angled section 226 of the sliding member, and vertical section 182 of the panel 156 (which is slightly taller than vertical section 170 of the panel 154) abuts opposite side 236 of the vertical section 220 of the sliding member and extends a short distance above the top of the section 220. A crimping or folding device of the type typically used in the installation of standing seam-type roof panels may then be used to bend the section 182 over the section 126 and toward the section 170 as shown to provide a standing seam 238 in vertical registry with the center of the pan 118 of the underlying rib-type panel 108.

With the standing seam 238 in vertical registry with the pan 118, the slide member of each clip 150 is disposed generally vertically above the rib 112 of the lower panel 108 and the base member of each clip is disposed close to one side of the rib 112 of the lower panel 108. This arrangement transmits the weight of the panels 154, 156 to the lower panel 108 to locations adjacent the ribs of the panel 108 and maintains a relatively uniform spacing, i.e., air gap, between the lower panels 108 and the upper panels 154, 156. This air gap is advantageous to provide an insulative layer of air or accommodates a layer of insulation. In addition, the clips 150 enable an efficient installation of a new standing seam-type roof system atop an existing rib-type roof system to avoid the cost and inconvenience associated with the removal of the existing ribbed roof prior to installation of a new standing seam roof system.

Figure 11:
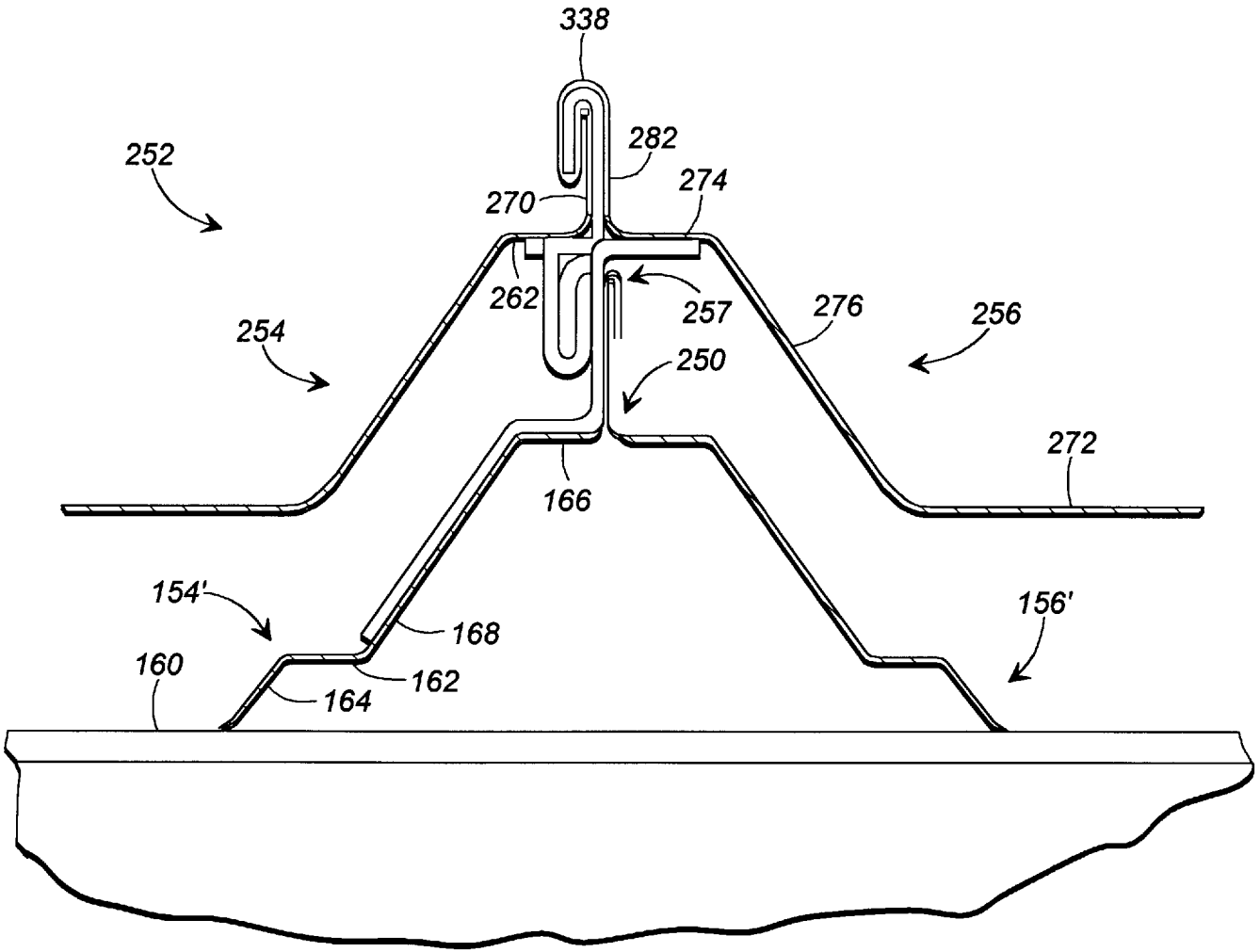
FIG. 11 is a fragmentary cross-sectional view of a roof structure within which another embodiment of a clip is incorporated. The clip of this embodiment is shown utilized for installation of a standing seam-type roof structure over a standing seam-type roof structure.
Figure 12A:
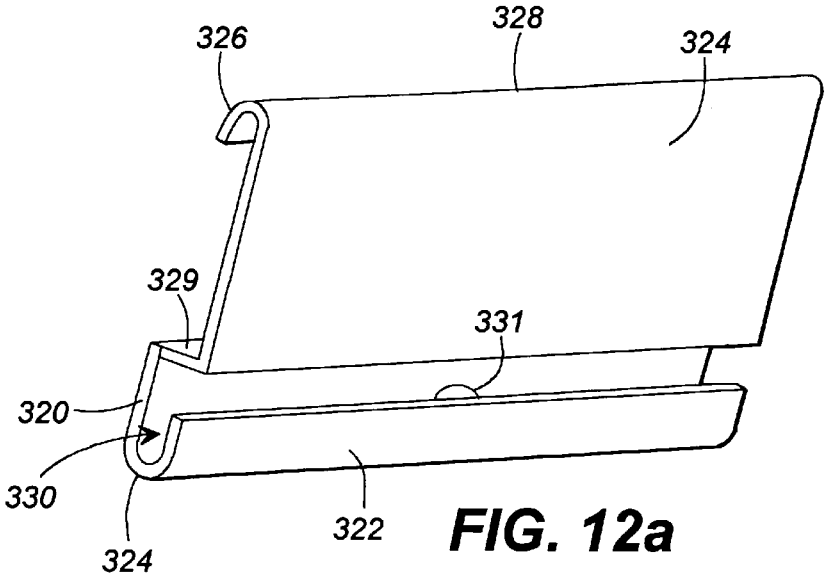
FIG. 12*a* is an enlarged view of the slide member of the clip.
Figure 12:
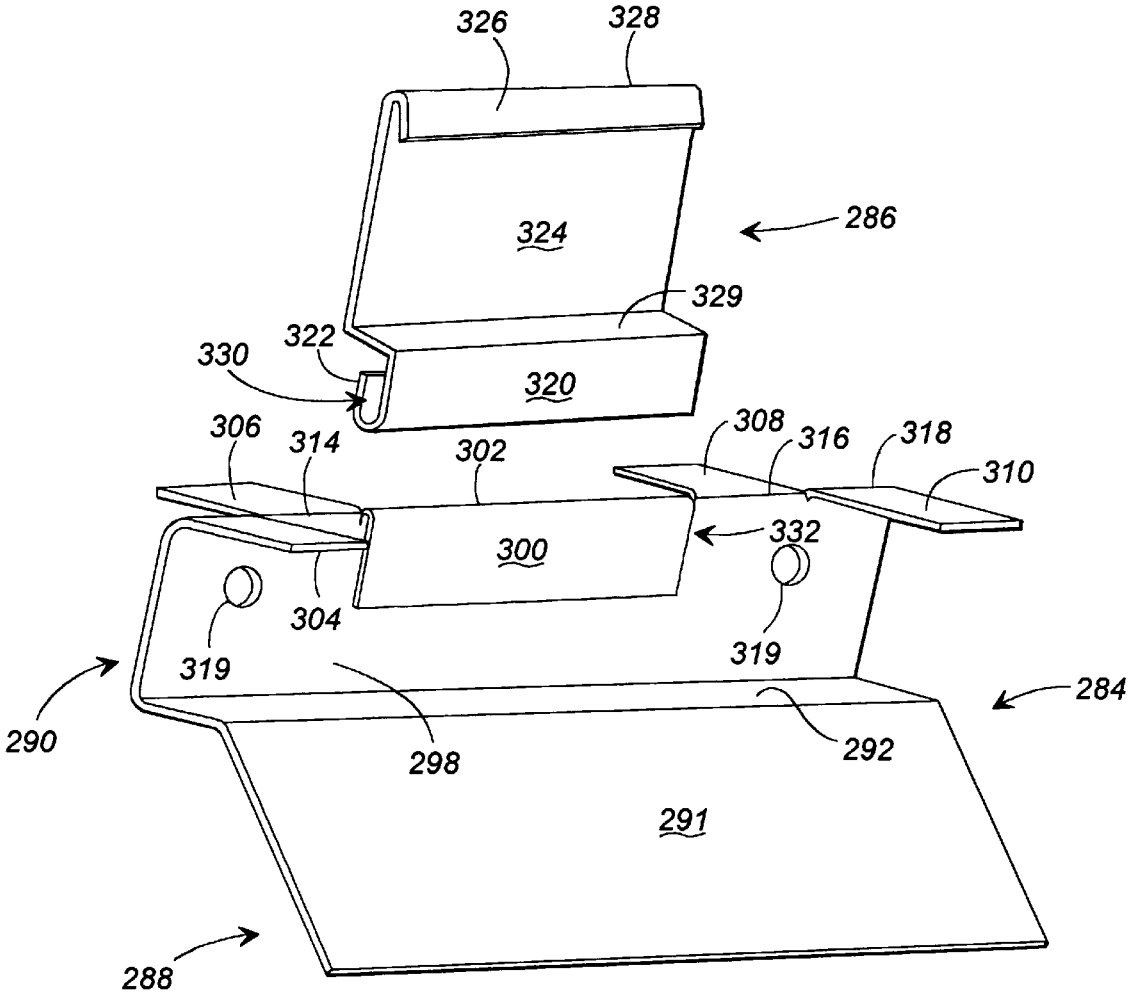
FIG. 12 is a perspective view of the clip of FIG. 11, shown exploded.
Figure 13:
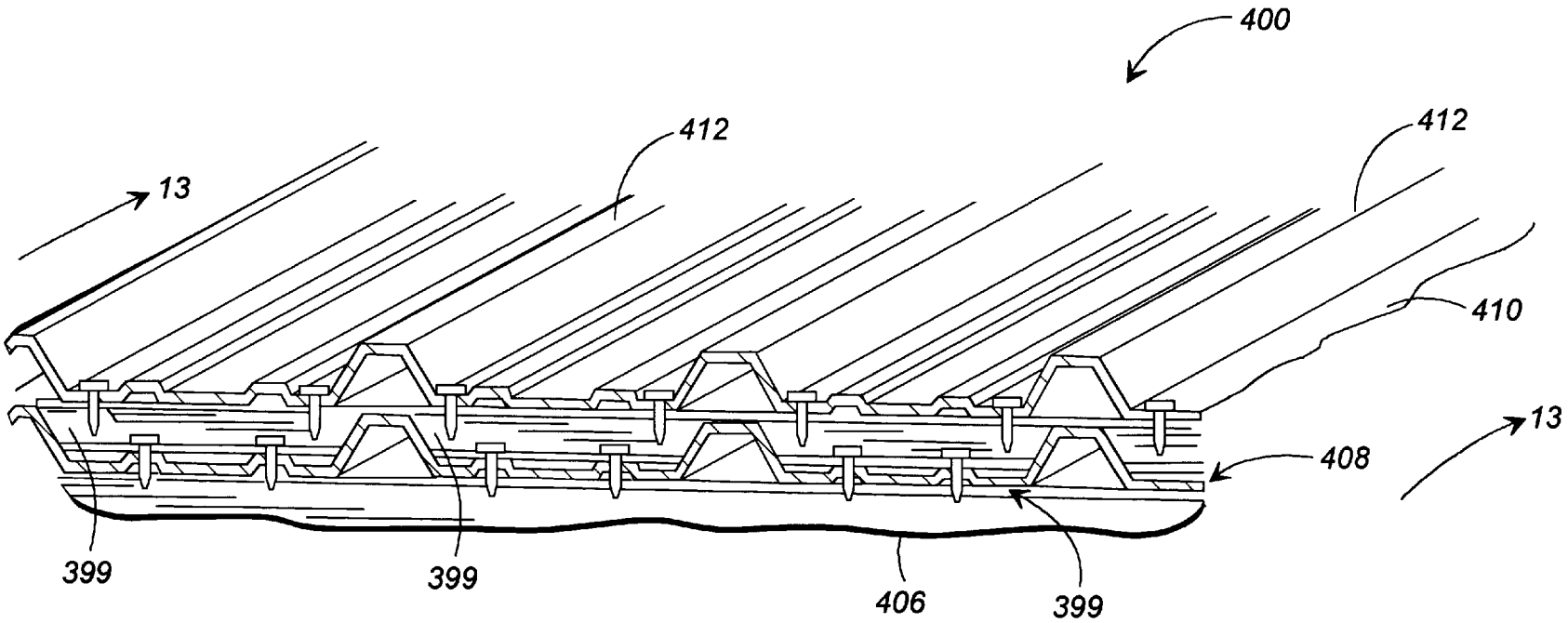
FIG. 13 is a fragmentary cross-sectional view of a roof structure and FIG. 13*a* is a perspective view of a roof structure within which another embodiment of a clip (a "V" clip) is incorporated. The clip of this embodiment is shown utilized for installation of a rib-type roof structure over a rib-type roof structure.
Figure 13A:
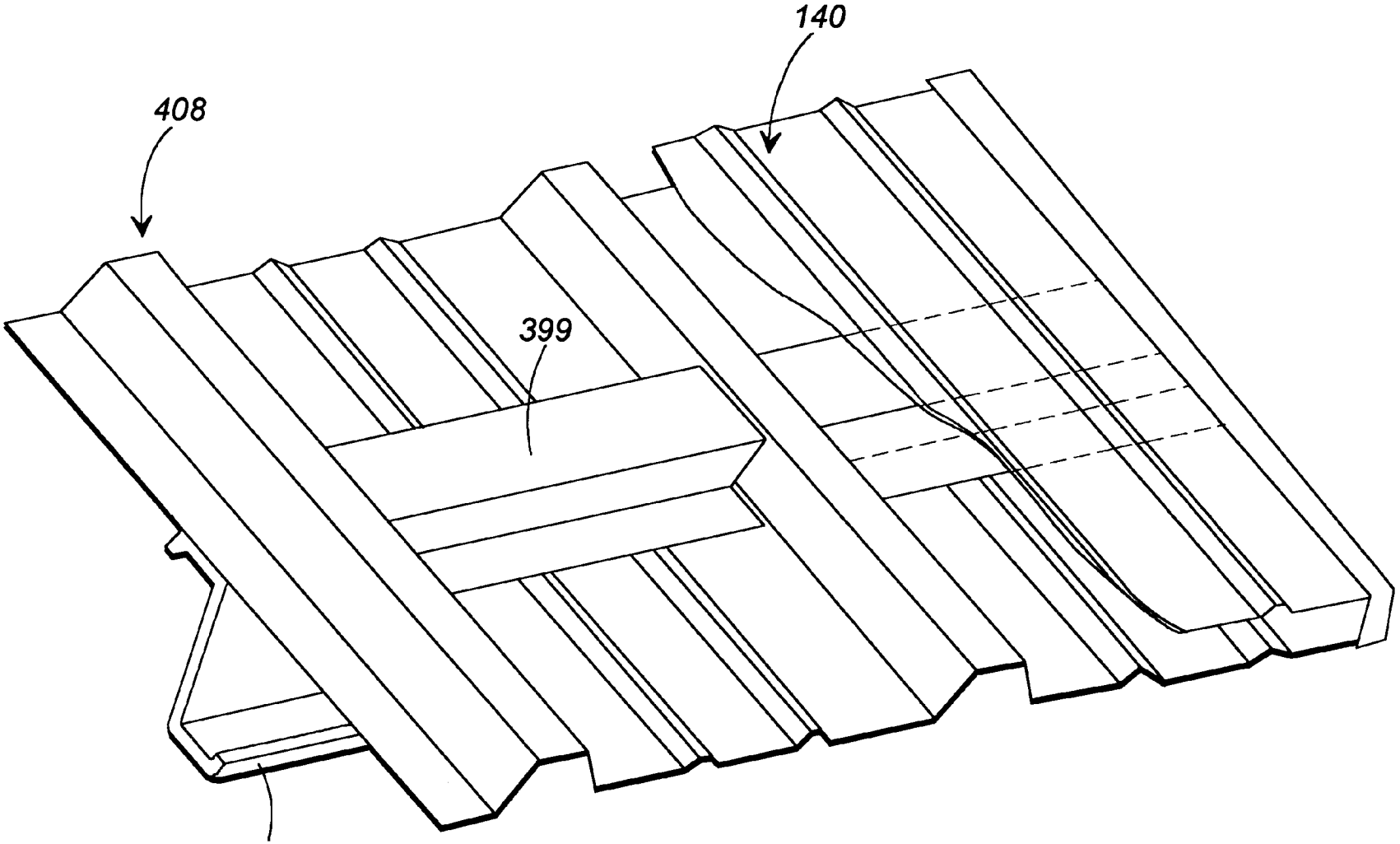

With reference to FIGS. 11–12*a* there is shown another embodiment of a clip 250 embodying features of the present invention utilized to provide a roof structure 252. In the roof structure 252, a standing seam-type roof provided by an upper layer of standing seam-type roof panels 254, 256 is mounted by use of a plurality of clips 250 in spaced relationship above an existing standing seam-type roof, such as a roof structure provided by standing seam panels like lower panels 154, 156 described previously in connection with FIG. 9, and which may be joined together in a conventional manner to provide a standing seam 257.

The panel 254 is a so-called Butler standing seam-type panel and includes horizontal sections 260, 262 connected by a sloped section 264 and a vertical section 270 extending upwardly from the edge of horizontal section 262 opposite the sloped section 264. The panel 256 may be identical in construction to the panel 254 and includes horizontal sections 272, 274 connected by a sloped section 276 and a vertical section 282 extending upwardly from the edge of horizontal section 274 opposite the sloped section 276. The vertical section 282 is preferably of greater height than the vertical section 270 of the roof panel 254 so that the section 282 has sufficient length to be folded over the clip 250 and the vertical section 270 to provide the standing seam, as explained below.

In a preferred embodiment, a plurality of the clips 250 are disposed between the lower standing seam-type panels 154, 156 and the upper standing seam-type panels 254, 256 in a re-roofing type application for supporting the standing seam-type panels 254, 256 in spaced relationship above the panels 154, 156. With reference to FIG. 12, each clip 250 includes a base member 284 and a slide member 286 which is interfitted with the base member 284 in a manner which permits the slide member 286 to shift longitudinally with respect to the base member 284.

The base member 284 includes a lower section 288 and an upstanding section 290 extending generally upwardly from the lower section 288. The lower section 288 includes an angled section 291 for stably overlying the sloped sections 168 (or 180) of the lower panel 154 (or 156) and a horizontal section 292 for overlying horizontal section 166 of the panel 154 (or horizontal section 178 of the panel 156).

The upstanding section 290 includes vertical sections 298 and 300 joined at a bend 302 and horizontal sections 304, 306, 308 and 310 joined to the vertical section 298 at bends 312, 314, 316 and 318, respectively. Apertures 319 extend the vertical section 298 at each end thereof for receiving mounting screw or bolts for connecting the clip 250 to the panels 154, 156.

The slide member 286 includes vertical sections 320 and 321 joined at bend 322, a vertical section 324 joined to an angled section 326 at bend 328, and a horizontal section 329 which extends between the uppermost edge of the vertical section 321 and the lowermost edge of the vertical section 324. The vertical sections 320 and 320 face one another and are spaced-apart by the bend 323 to provide a U-shaped channel 330 which is configured to be slidingly received within a corresponding U-shaped channel 332 provided by vertical sections 298 and 300.

Assembly of the clip is uncomplicated and may be accomplished by positioning the vertical section 328 of the slide member between sections 298 and 300 of the base member so that the vertical section 320 extends into the channel 332 and the section 300 extends into the channel 330. A protrusion 331 and corresponding detent (not shown) for receiving the detent are preferably provided midway along the length of the sections 320 and 300, respectively, to facilitate maintenance of the clip in the assembled configuration during transportation and installation of the clip. Longitudinal travel of the slide member 286 relative to the base member 284 when the clip 250 is installed is limited by horizontal sections 306 and 308, as explained more fully below.

Installation of the roof structure 252 may be accomplished by securing a plurality of the assembled clips 250 to the underlying panels 154, 156 by use of screws or bolts received through the apertures 319 and corresponding apertures in the panels 154, 156. The standing seam roof panels 254, 256 may be mounted to the clips in a manner similar to that described previously in connection with FIGS. 9–10. For example, panels 254 and 256 are positioned adjacent to one another on opposite sides of the clip 250 so that horizontal section 262 of the panel 254 rests on and is supported by horizontal sections 306 and 308 of the clip, horizontal section 274 of the panel 256 rests on and is supported by horizontal sections 304 and 310 of the clip 250, vertical section 270 of the panel 254 abuts one side of the vertical section 324 of the sliding member 286 immediately below angled section 326 of the sliding member, and vertical section 282 of the panel 256 abuts the opposite side of the vertical section 324 and extends a short distance thereabove. A crimping device may then be used to bend the section 282 over the angled section 326 and the vertical section 270 as shown to provide a standing seam 338 in vertical registry with the underlying seam 257.

With reference to FIGS. 13–20, there is illustrated an alternative embodiment of a V-clip 399 embodying features of the present invention shown utilized in a rib-type roof structure 400. The roof structure 400 is supported atop a plurality of purlins 406 in a manner similar to that described in connection with the roof structure 20 described in FIG. 1. Included in the structure 400 is a first, or lower, layer of panels 408 and a second, or upper layer of panels 410 disposed above the first layer of panels 408. The panels 408 and 410 may be identical in construction and each may include a plurality of ribs 412 extending longitudinally of the panel.

In a manner similar to that described in connection with the embodiment of FIG. 7, each rib 412 may be formed with two opposing sloped sidewalls 414, 416 and a flat or land section 418 which extends between the sidewalls 414, 416 adjacent the top thereof. Optionally, the rib-type panels may also include one or more smaller ribs 420 between adjacent ribs 412. Each panel 408 or 410 partially overlaps an adjacent panel 408 or 410 in its corresponding layer so that at least one rib 412 of one panel 408 or 410 matingly overlaps at least one rib 412 of an adjacent panel 408 or 410 to provide an overall uniform arrangement of continuous, parallel, evenly spaced-apart ribs extending across the width of the structure 400.

Figure 15:
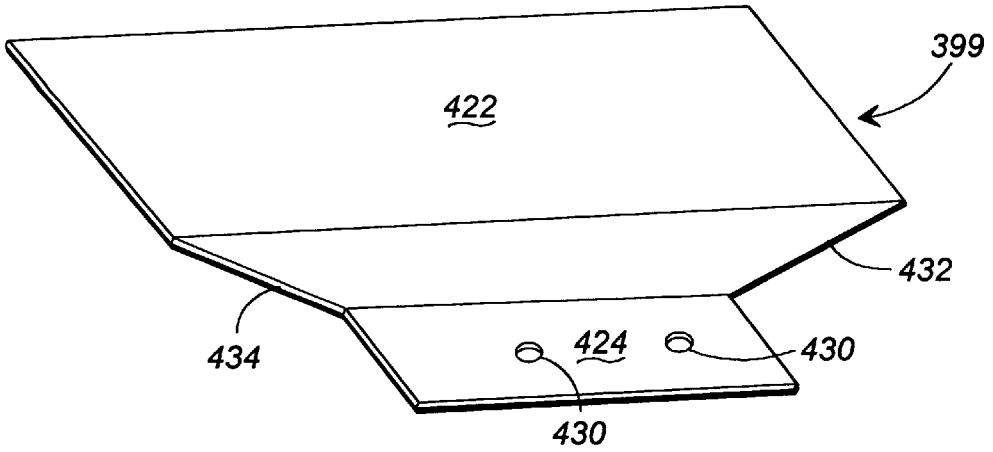
FIG. 15 is a perspective view of the V-clip of FIG. 13.
Figure 16:
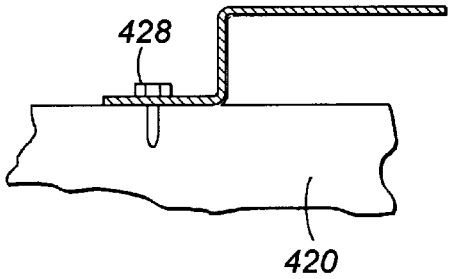
FIG. 16 is a cross-sectional side view of the V-clip of FIG. 15.
Figure 17:
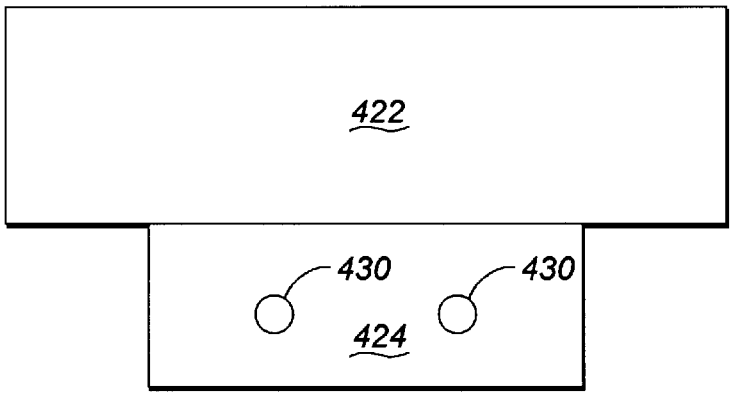
FIG. 17 is a top plan view of the V-clip of FIG. 15.
Figure 18:
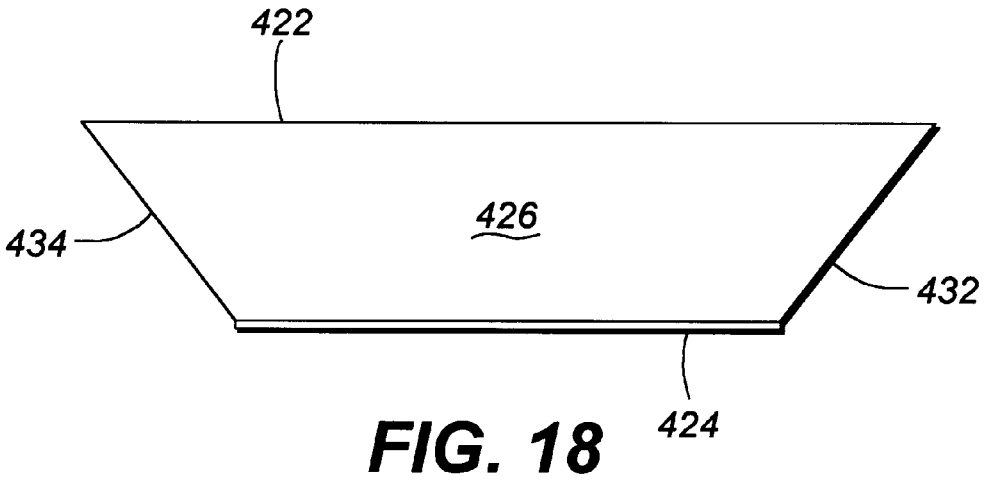
FIG. 18 is a front plan view of the V-clip of FIG. 15.

In the depicted roof structure 400, a plurality of the clips 399 are disposed between the lower layer of panels 408 and the upper layer of panels 410 for supporting the panels 408 and 410 in a spaced parallel relationship. As best shown in FIGS. 15–17, each clip 399 is of one piece construction and is preferably "V" shaped in cross-section and includes a flat top portion 422 vertically aligned with and spaced above a flat bottom portion 424 by middle portion 426 extending between the top and bottom portions of the clip.

Figure 14:
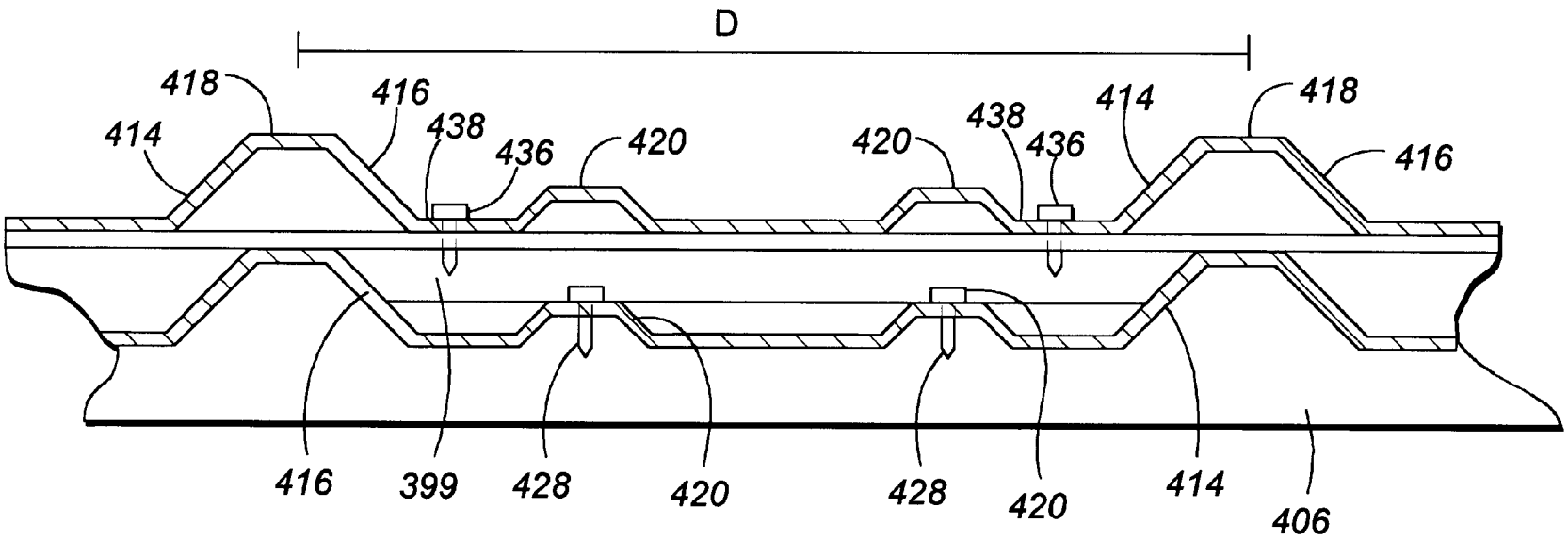
FIG. 14 is an enlarged cross-sectional view of FIG. 13 taken along line 13—13.
Figure 19:
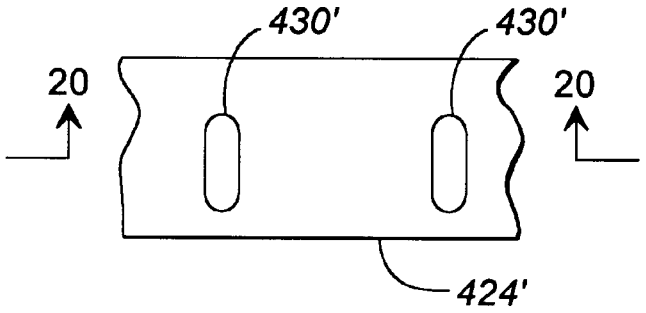
FIG. 19 is a partial top plan view of the bottom portion of the clip showing the use of elongate slots instead of circular apertures for passage of the fasteners to permit movement of the clip relative to the underlying structure.
Figure 20:
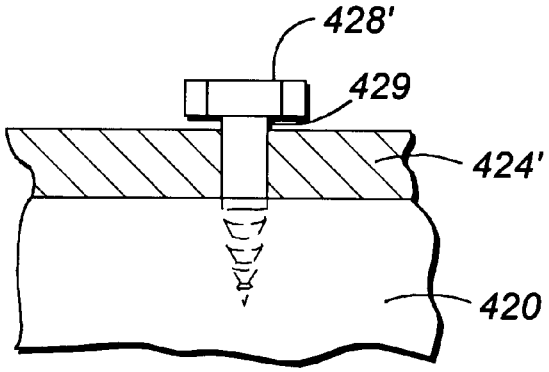
FIG. 20 is a cross-sectional view of FIG. 19 taken along line 20—20 showing a fastener having an unthreaded neck which is suitable for use with the elongate slots of FIG. 19.

As shown in FIG. 14, the clips are positioned between adjacent ribs 412, preferably directly on the ribs 420 of the lower panels 408, and may be attached to the purlins 406 underlying the lower panels by fasteners 428, such as self-tapping sheet metal screws extending through apertures 430 located on the bottom portion 424 of the clip 399. As shown in FIGS. 19–20, the apertures may be provided in the form of slots 430' and the fasteners provided by self-tapping screws or the like having a smooth neck section 429. As will be appreciated, the use of the screws 428' and the slots 430' enables the clip 399 to move relative to the underlying roof panels.

The top portion 422 of the clip 399 preferably has a length which corresponds to the distance D (FIG. 14) between the outer edges of adjacent flat sections 418 of the panels 410 so that the top portions 422 are flush with but do not overly the flat sections 418 of the ribs 412. To aid in stability, the middle portions preferably correspond in configuration to the sloped sidewalls so that the middle portions abut the sloped sidewalls of the ribs 412. For example, middle section 426 preferably includes opposite side edges 432 and 434 which are sloped such that edge 432 matingly engages sidewall 414 of one of the ribs 412 and edge 434 matingly engages sidewall 416 of the adjacent rib 412.

The upper layer of panels is preferably attached directly to the top portions 422 of the installed clips 399 by fasteners 436, such as self-tapping screws, which preferably pierce the panels 412 at flat sections 438 thereon between the ribs 412 and 420 which directly contact the underlying top portions 422 of the clips 399.

Figure 21:
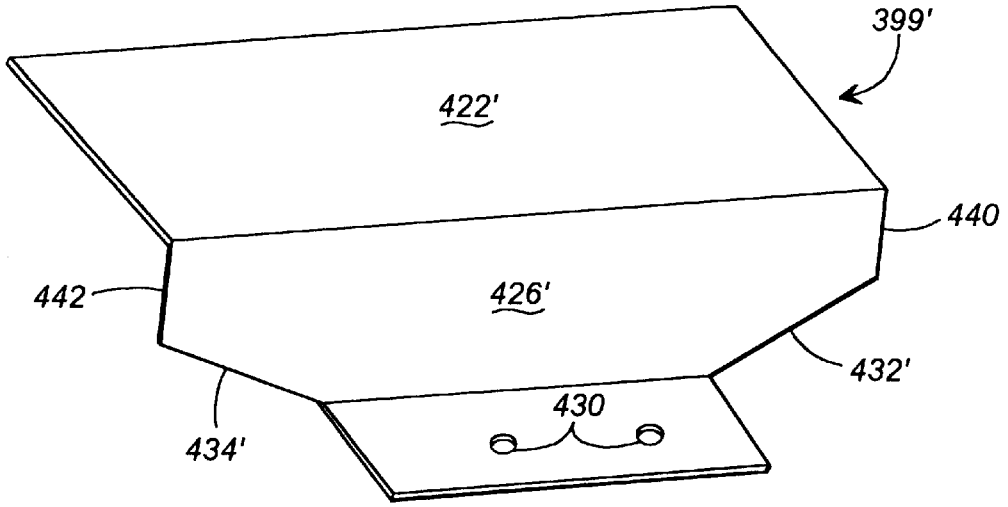
FIG. 21 is a perspective view of another embodiment of a V-clip useful for installation of a rib-type roof structure over a rib-type roof structure.
Figure 22:
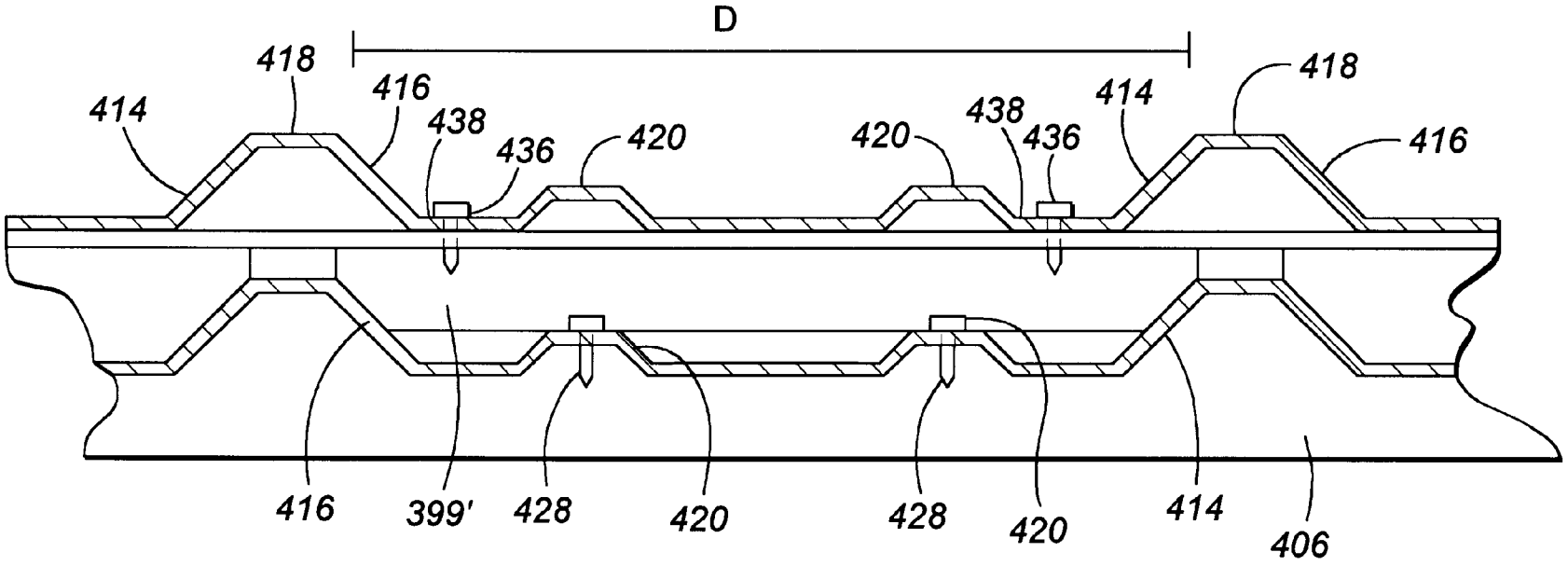
FIG. 22 is a cross-sectional view of a roof structure within which the clip of FIG. 21 is incorporated.

With reference to FIGS. 21 and 22, there is shown another embodiment of a clip 399', which is identical to the clip 399, except that the middle portion 426 extends higher than the middle portion 426 to raise the top portion 422' to a greater height than the height of the top portion 422. As will be recalled, the top portion 422 of the clip 399 is preferably flush with the top of the ribs 412. Thus, the clip 399' is useful for re-roofing situations where it is desirable to space the new roof a greater distance above the old roof. To accomplish this, the middle portion 426' includes vertical side edges 440 and 442 which extend upwardly from the uppermost edges of the sloped sidewalls 432 and 434, respectively.

Figure 23:
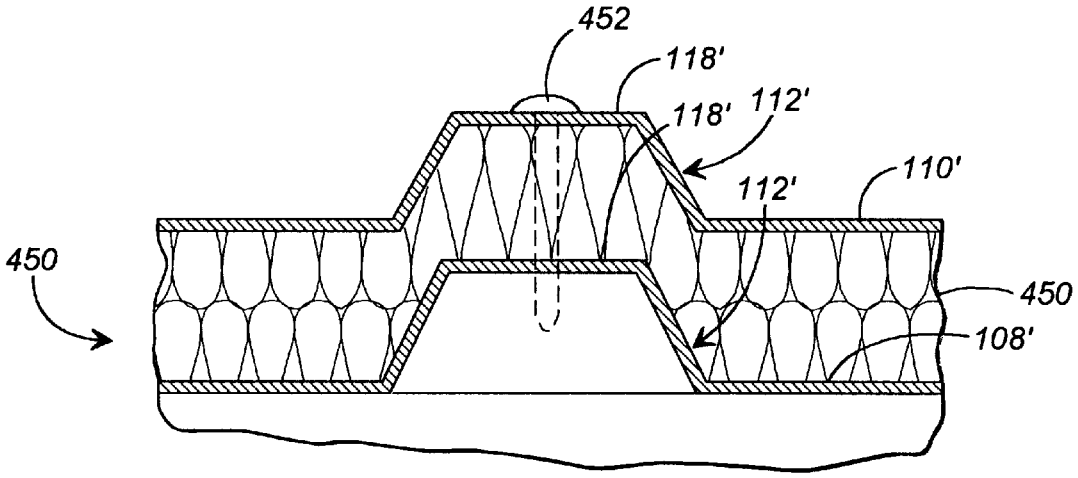
FIG. 23 is a cross-sectional view of another embodiment of the invention wherein ribs of overlying panels are superposed in vertical registry in spaced relationship.

As shown in FIG. 23, in another embodiment based upon the originally disclosed concept of overlying ribs of superposed panels connected together in vertical registry, the second panels 110' of the overlying or new roof may be attached directly onto the underlying panels 108' with their respective ribs 112' vertically aligned, and a continuous layer of sprayed on or sheet-type insulation 450 or a vapor barrier or coating applied therebetween. Fasteners or connectors 452, which may be self-tapping sheet metal screws as shown, one driven through both of the high flat or lands 118' of the two superposed panels. The insulation 450 or other material supplied between the layers is preferably sufficient to at least avoid metal to metal contact and to limit moisture transfer. Accordingly, the distance remaining between the panels 110' and 108' in this embodiment may be paper-thin or relatively thick and, for example, may be in the order of from about 1/32 of an inch to several inches.

Fasteners 452 may provide some degree of longitudinal shifting of the panels, although not to the same degree as clips 40 or 90, and therefore this embodiment may be advantageous when a lesser amount of accommodation for relative longitudinal movement between the layers is needed or desired.

Figure 25:
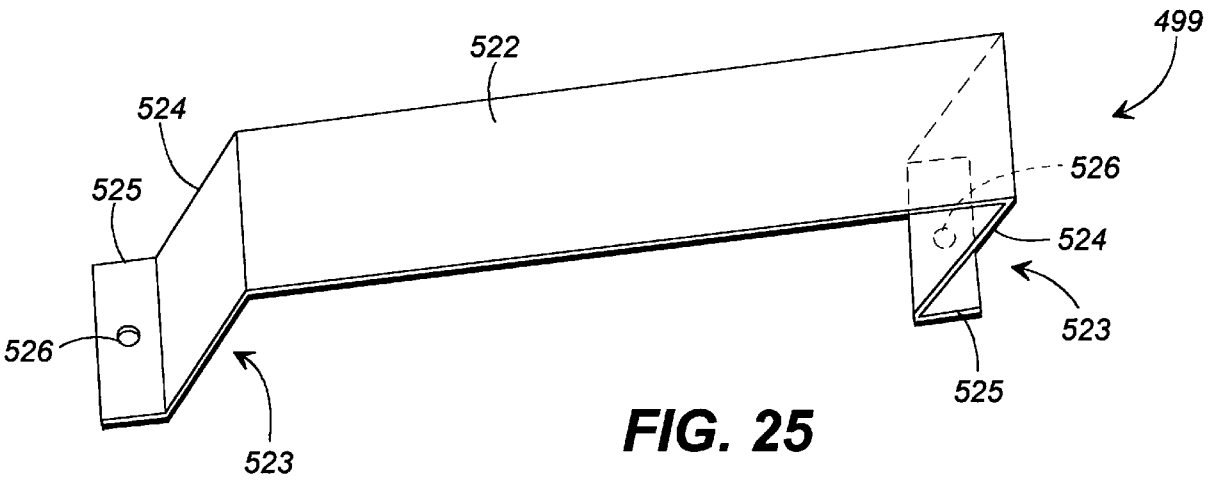
FIG. 25 is a perspective view of the U-clip of FIG. 24.
Figure 24:
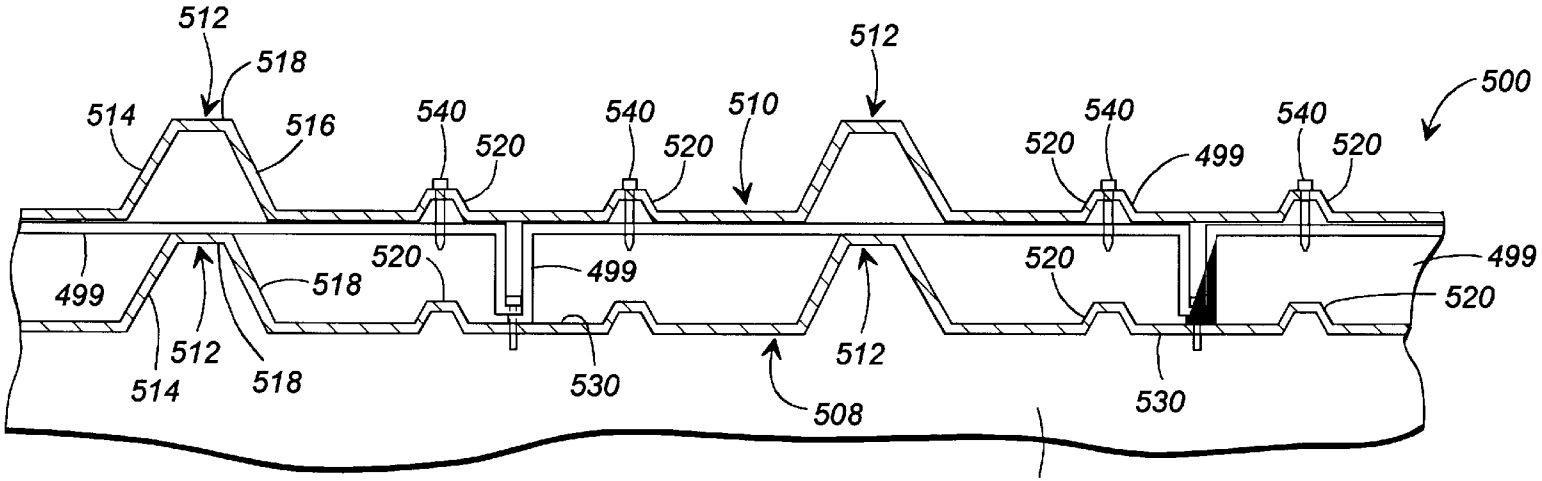
FIG. 24 is a cross-sectional view of a roof structure within which another embodiment of a clip (a "U" clip) is incorporated. The clip of this embodiment is shown utilized for installation of a rib-type roof structure over a rib-type roof structure.
Figure 26:
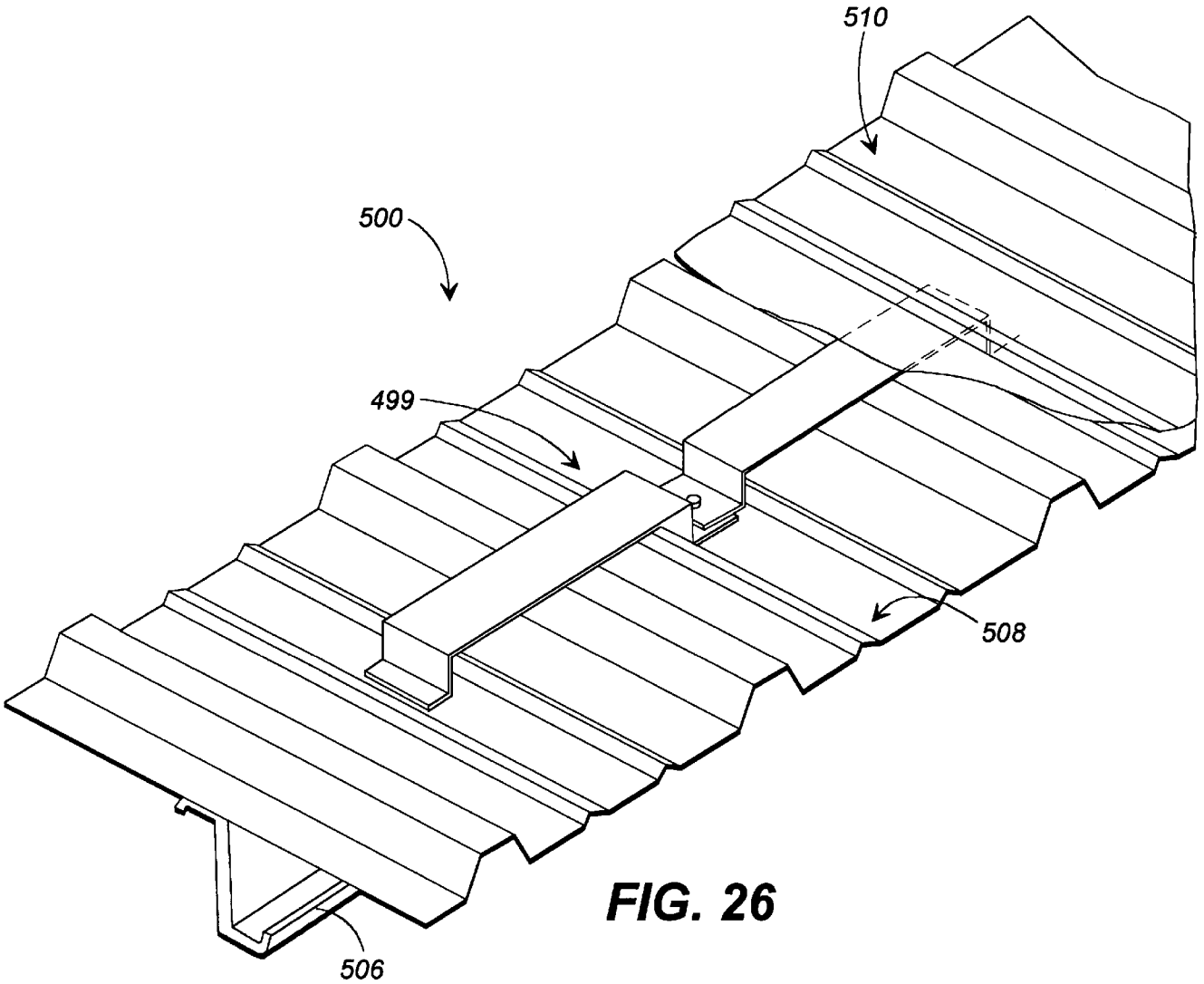
FIG. 26 is a perspective view of the roof structure of FIG. 24.

With reference to FIGS. 24–26, there is illustrated an alternative embodiment of a clip 499 embodying features of the present invention shown utilized in a rib-type roof structure 500. The roof structure 500 is supported atop a plurality of purlins 506 in a manner similar to that described in connection with the roof structure 20 described in FIG. 1. Included in the structure 500 is a first, or lower, layer of panels 508 and a second, or upper layer of panels 510 disposed above the first layer of panels 508. The panels 508 and 510 may be identical in construction and each may include a plurality of ribs 512 extending longitudinally of the panel. In a manner similar to that described in connection with the embodiment of FIGS. 13–15, each rib 512 may be formed with two opposing sloped sidewalls 514, 516 and a flat or land section 518 which extends between the sidewalls 514, 516 adjacent the top thereof. In addition, the rib-type panels preferably include one or more smaller ribs 520 between adjacent ribs 512.

In the depicted roof structure 500, a plurality of the clips 499 are disposed between the lower layer of panels 508 and the upper layer of panels 510 for supporting the panels 508 and 510 in a spaced parallel relationship. Each clip 499 is of one piece construction and is preferably "U" shaped in cross-section and includes a flat top portion 522 supported by "L" shaped legs 523 provided at opposite ends of the top portion 522. The legs 523 each include a vertical section 524 connected to the top portion along a bend and a horizontal portion 525 connected to the lowermost portion of the vertical section 524 along a bend. An aperture 526 is preferably provided through the central portion of the horizontal section 525 of each leg for receiving a fastener, such as a self-tapping sheet metal screw or rivet or bolt, for attaching the clip 499 to the purlins 506 underlying the lower roof panels 508.

The clips 499 are preferably positioned with one of the horizontal sections 525 of each clip directly on the lower panels 508 and the opposite horizontal section 525 resting on the horizontal section of the previous clip 499 such that the apertures 526 are aligned. The clips are also preferably positioned such that the horizontal sections 522 of the legs are located in low or pan sections 530 of the lower panels 508 in between adjacent ribs 520 of the lower panels such that the top portions 522 of the clips span the ribs 512.

The top portion 522 of each clip 499 preferably has a length which corresponds to the distance between the mid-sections of adjacent pan sections 530 of the panels. The upper layer of panels is preferably attached directly to the top portions 522 of the installed clips 499 by fasteners 540, such as self-tapping screws, which preferably pierce the ribs 520 of the upper layer of panels.

It will be understood that numerous modifications and substitutions can be had to the aforedescribed embodiment without departing from the spirit of the invention. Accordingly, the aforedescribed embodiments are intended for the purpose of illustration and not as limitation.

I claim:

1. In combination:

an existing ribbed roof structure including at least one ribbed roof panel having at least one longitudinal rib provided by opposite sloped sidewalls and a land extending between the sidewalls;

an additional roof structure including at least two standing seam roof panels, each of the standing seam panels having a raised edge extending the length thereof, said raised edges of said panels being positioned adjacent one another and the standing seam panels interconnected to one another along the raised edges; and a plurality of clips for slidably supporting the standing seam roof panels of the additional roof structure in a spaced relationship above the ribbed roof panel of the existing roof, each of the clips including:

a) a base member having a lower section for securement of the base member in a stationary relationship with the ribbed roof panel adjacent one of its ribs and an upstanding section extending upwardly from the lower section; and b) a slide member having an upper section for attachment to the adjacent raised edges of the standing seam roofs panel placed upon the clip and having a depending section depending downwardly from the upper section, the depending section being interfitted with the upstanding section in a manner which permits the slide member to shift relative to the base member to accommodate a dimensional change in the standing seam panels relative to the underlying ribbed roof panel;

the upstanding section of the base member including a first portion which is shaped in conformance with the shape of one of the sidewalls of a preselected rib of the ribbed panel so that when the base member is secured to the ribbed roof panel adjacent the preselected rib, the first portion engagably lies against a sidewall of the preselected rib;

the upper section of the slide member being configured for positioning between the adjacent raised edges of adjacent standing seam panels, with one of the raised edges folded over the upper section of the slide member and the other raised edge to provide a standing seam between the standing seam panels for connecting the standing seam panels to one another;

the upper section being disposed in such a positional relationship relative to the base member so that when the lower section of the base member is secured to the ribbed roof panel with its first portion engagably lying against a sidewall of a preselected rib of the ribbed panel and the upper section is positioned between the raised edges of the standing seam panels to provide the standing seam, the pan of the preselected rib of the ribbed roof panel and the standing seam connecting adjacent standing seam panels are in vertical registry at the clip and so that the standing seam panels are permitted to shift as a unit relative to the existing roof structure as the slide members of the clips are permitted to shift relative to the base members of the clips.

2. The combination of claim 1 wherein each of the lower and upper sections of the clip is elongate in form and arranged so that the longitudinal axes of the lower and upper sections are parallel to one another so that when the lower section of the base member is secured to the ribbed roof panel so that the longitudinal axis of the lower section is parallel to the run of the ribs of the ribbed roof panel and the upper section is positioned between the raised edges of the standing seam panels to provide the standing seam roof panel so that the longitudinal axis of the upper section is parallel to the run of the standing seam and the ribs of the ribbed roof panel and the standing seam of the standing seam roof panels are parallel to one another.

3. A roof system, comprising:

a layer of interconnected ribbed roof panels, each ribbed roof panel having a plurality of upwardly projecting reinforcing ribs extending in spaced-apart side-by-side adjacency along the ribbed roof panel;

a layer of interconnected standing seam roof panels spaced above the layer of ribbed roof panels, wherein adjacent panels are interconnected along a standing seam extending upwardly away from the underlying layer of ribbed roof panels; and means for supporting the layer of standing seam roof panels in spaced-apart relation above the layer of ribbed roof panels with the standing seams of the layer of standing seam panels generally vertically aligned with the ribs of the layer of ribbed panels, the means for supporting includes means for permitting movement of at least a portion of the layer of standing seam panels, as a unit, relative to the layer of ribbed panels.

4. The roof system of claim 3, wherein the means for supporting comprising a plurality of spaced-apart clips located between the layer of ribbed roof panels and the layer of standing seam roof panels, each of the clips comprising a first part fixedly attached to the layer of ribbed roof panels and a second part fixedly attached to the layer of standing seam roof panels and means interconnecting the first and second parts so as to permit relative movement between the first and second parts to thereby permit movement of at least a portion of the panels of the second layer of panels relative to the first layer.

5. The roof system of claim 4, wherein the layer of ribbed panels and the layer of standing seam panels are each generally planer in configuration and are disposed in generally parallel planes, the means for interconnecting comprising means for permitting movement of the second part of the clip relative to the first part of the clip in a direction generally parallel to the plane of the layer of standing seam panels.

6. A roof system which comprises a building structure, a layer of contiguous interconnected ribbed roof panels positioned in an overlying relationship to and connected to the building structure, a layer of contiguous interconnected standing seam roof panels, means for connecting the layer of ribbed roof panels to the building structure, and means for supporting the layer of standing seam roof panels in spaced-apart relation above the layer of ribbed roof panels, the means for supporting including means for permitting movement of at least a portion of at least one of the layers of interconnected roof panels, as a unit, relative to the building structure.

7. A roof system which comprises a first layer of interconnected ribbed roof panels, each ribbed roof panel having a longitudinal rib thereon, a second layer of standing seam roof panels, wherein adjacent ones of the standing seam panels are interconnected along a standing seam, and means for movably supporting the layer of standing seam roof panels above the layer of ribbed panels to accommodate longitudinal movement of the layers relative to one another.

8. The roof system of claim 7, wherein the ribs of the layer of ribbed panels are generally vertically aligned with the standing seams of the layer of standing seam panels.

9. In combination:

an existing standing seam roof structure having first and second standing seam roof panels, each of the first and second standing seam panels having a raised edge extending the length thereof, the raised edges of the first and second panels being positioned adjacent to another and the first and second standing seam panels interconnected to one another along the raised edges of the first and second panels to provide a first standing seam;

an additional standing seam roof structure having third and fourth standing seam roof panels, each of the third and fourth standing seam panels having a raised edge extending the length thereof, the raised edges of the third and fourth panels being positioned adjacent to another and the third and fourth standing seam panels interconnected to one another along the raised edges of the third and fourth panels;

a plurality of clips for slidably supporting the third and fourth standing seam roof panels of the additional roof structure in a spaced relationship above the first and second standing seam roof panels of the existing roof, each of the clips including a) a base member having a lower section for securement of the base member in a stationary relationship with the first and second roof panels of the existing roof structure and an upstanding section extending upwardly from the lower section; and b) a slide member having an upper section for attachment to adjacent raised edges of the third and fourth standing seam roofs panel placed upon the clip and having a depending section depending downwardly from the upper section, the depending section being interfitted with the upstanding section in a manner which permits the slide member to shift relative to the base member to accommodate a dimensional change in the third and fourth standing seam panels relative to the underlying existing roof structure;

the upper section of the slide member being configured for positioning between the adjacent raised edges of adjacent standing seam panels, with one of the raised edges folded over the upper section of the slide member and the other raised edge to provide a second standing seam between the third and fourth standing seam panels for connecting the third and fourth standing seam panels to one another;

the upper section being disposed in such a positional relationship relative to the base member so that when the lower section of the base member is secured to the first and second roof panels and the upper section is positioned between the raised edges of the third and fourth standing seam panels to provide the second standing seam, the first and second standing seams are in vertical registry at the clip and so that the third and fourth standing seam panels are permitted to shift as a unit relative to the existing roof structure as the slide members of the clips are permitted to shift relative to the base members of the clips.

10. A roof system, comprising:

a first layer of interconnected standing seam roof panels, wherein adjacent panels are interconnected along a standing seam;

a second layer of interconnected standing seam roof panels spaced above the first layer of standing seam roof panels, wherein adjacent panels are interconnected along a standing seam; and means for supporting the second layer of standing seam roof panels in spaced-apart relation above the first layer of standing seam roof panels with the standing seams of the second layer of standing seam panels generally vertically aligned with the standing seams of the first layer of standing seam roof panels, the means for supporting includes means for permitting movement of at least a portion of the second layer of standing seam panels, as a unit, relative to the first layer of standing seam roof panels.

11. The roof system of claim 10, wherein the means for supporting comprising a plurality of spaced-apart clips located between the first layer of standing seam roof panels and the second layer of standing seam roof panels, each of the clips comprising a first part fixedly attached to the first layer of standing seam roof panels and a second part fixedly attached to the second layer of standing seam roof panels and means interconnecting the first and second parts so as to permit relative movement between the first and second parts to thereby permit movement of at least a portion of the panels of the second layer of panels relative to the first layer.

12. The roof system of claim 11, wherein each of the layers of standing seam panels are generally planer in configuration and are disposed in generally parallel planes, the means for interconnecting comprising means for permitting movement of the second part of the clip relative to the first part of the clip in a direction generally parallel to the plane of the second layer of standing seam panels.

13. A roof system which comprises a building structure, a layer of contiguous interconnected ribbed roof panels positioned in an overlying relationship to and connected to the building structure, a layer of contiguous interconnected standing seam roof panels, means for connecting the layer of ribbed roof panels to the building structure, and means for supporting the layer of standing seam roof panels in spaced-apart relation above the layer of ribbed roof panels, the means for supporting including means for permitting movement of at least a portion of at least one of the layers of interconnected roof panels, as a unit, relative to the building structure.

14. A roof system which comprises a first layer of standing seam roof panels, wherein adjacent ones of the standing seam panels of the first layer are interconnected along first standing seams, a second layer of standing seam roof panels, wherein adjacent ones of the standing seam panels of the second layer are interconnected along second standing seams, and means for movably supporting the second layer of standing seam roof panels above the first layer of standing seam roof panels to accommodate longitudinal movement of the layers relative to one another.

15. The roof system of claim 14, wherein the first standing seams of the first layer of standing seam roof panels are generally vertically aligned with the second standing seams of the second layer of standing seam roof panels.

16. A roof system, comprising:

a first layer of interconnected standing seam roof panels, wherein adjacent panels are interconnected along a standing seam;

a second layer of interconnected standing seam roof panels spaced above the first layer of standing seam roof panels, wherein adjacent panels are interconnected along a standing seam; and means for supporting the second layer of standing seam roof panels in spaced-apart relation above the first layer of standing seam roof panels with the standing seams of the second layer of standing seam panels generally vertically aligned with the standing seams of the first layer of standing seam roof panels.

17. The roof system of claim 16, wherein the means for supporting includes means for permitting movement of at least a portion of the second layer of standing seam panels, as a unit, relative to the first layer of standing seam roof panels.

18. The roof system of claim 16, wherein the means for supporting comprising a plurality of spaced-apart clips located between the first layer of standing seam roof panels and the second layer of standing seam roof panels, each of the clips comprising a first part fixedly attached to the first layer of standing seam roof panels and a second part fixedly attached to the second layer of standing seam roof panels and means interconnecting the first and second parts so as to permit relative movement between the first and second parts to thereby permit movement of at least a portion of the panels of the second layer of panels relative to the first layer.

19. The roof system of claim 16, wherein each of the layers of standing seam panels are generally planer in configuration and are disposed in generally parallel planes, the means for interconnecting comprising means for permitting movement of the second part of the clip relative to the first part of the clip in a direction generally parallel to the plane of the second layer of standing seam panels.

20. A clip for slidably attaching a ribbed metal roof panel to a support underlying the roof panel, the clip comprising:

a base member having an elongate lower section for securement of the base member in a stationary relationship with the support and an upstanding section being U-shaped in cross-section along its length so that the U-shape of the cross-section has a bend and two legs which are joined at the bend of the U-shape, one leg of the U-shape of the base member being joined directly to the lower section and extending upwardly therefrom to the bend of its U-shape and the other leg of the U-shape of the base member extending downwardly from the bend of its U-shape to a location spaced above the lower section; and a slide member having an elongate upper section for attachment to a roof panel positionable upon the clip and having a depending section depending downwardly from the upper section, the depending portion being U-shaped in cross-section along its length so that the U-shape of the cross-section has a bend and two legs which are joined to the bend of the U-shape, a first leg of the U-shape of the slide member being joined directly to the upper section and extending generally downwardly therefrom to the bend of its U-shape and the second leg of the U-shape of the slide member extending generally upwardly from the bend of its U-shape, the depending section and the upstanding section being interfitted with one another to enable the slide member to shift longitudinally relative to the base member, with the upper surface of the upper section extending laterally and perpendicular relative to the bend for contacting the roof panel.

21. The clip of claim 20, wherein the support underlying the roof panel comprises a purlin.

22. The clip of claim 20, wherein the support underlying the roof panel comprises a roof panel.

23. A roof system, comprising:

a layer of interconnected ribbed roof panels, each ribbed roof panel having a plurality of upwardly projecting reinforcing ribs extending in spaced-apart side-by-side adjacency along the ribbed roof panel;

a layer of interconnected standing seam roof panels spaced above the layer of ribbed roof panels, wherein adjacent panels are interconnected along a standing seam extending upwardly away from the underlying layer of ribbed roof panels; and means for supporting the layer of standing seam roof panels in spaced-apart relation above the layer of ribbed roof panels with the standing seams of the layer of standing seam panels generally vertically aligned with the ribs of the layer of ribbed panels, the means for supporting including means for permitting movement of at least a portion of the layer of standing seam panels, as a unit, relative to the layer of ribbed panels.

24. A roof system, comprising:

a layer of interconnected ribbed roof panels, each ribbed roof panel having a plurality of upwardly projecting reinforcing ribs extending in spaced-apart side-by-side adjacency along the ribbed roof panel;

a layer of interconnected standing seam roof panels spaced above the layer of ribbed roof panels, wherein adjacent panels are interconnected along a standing seam extending upwardly away from the underlying layer of ribbed roof panels; and a plurality of spaced-apart clips located between the layer of ribbed roof panels and the layer of standing seam roof panels for supporting the layer of standing seam roof panels in spaced-apart relation above the layer of ribbed roof panels with the standing seams of the layer of standing seam panels generally vertically aligned with the ribs of the layer of ribbed panels, each of the clips comprising a first part fixedly attached to the layer of ribbed roof panels and a second part fixedly attached to the layer of standing seam roof panels and means for interconnecting the first and second parts so as to permit relative movement between the first and second parts to thereby permit movement of at least a portion of the panels of the second layer of panels relative to the first layer.

25. The roof system of claim 24, wherein the layer of ribbed panels and the layer of standing seam panels are each generally planer in configuration and are disposed in generally parallel planes, the means for interconnecting comprising means for permitting movement of the second part of the clip relative to the first part of the clip in a direction generally parallel to the plane of the layer of standing seam panels.

26. A roof system for a building structure including spaced-apart elongate roof support purlins which comprises a first layer of elongate contiguous ribbed roof panels having elongate upstanding ribs and being connected in side-by-side and end-to-end adjacency positioned in an overlying relationship to the purlins of the building structure, means for connecting the first layer of ribbed roof panels to the building structure with the ribs extending generally transversely to the purlins; a second layer of contiguous interconnected ribbed roof panels having elongate upstanding ribs and being connected in side-by-side and end-to-end adjacency positioned above the first layer of ribbed roof panels with one or more of the ribs of the second layer of panels generally vertically aligned with one or more of the ribs of the first layer of ribbed panels, and means for connecting the second layer of ribbed panels to the first layer of ribbed panels in substantially continuous spaced-apart relation including a plurality of spaced-apart connectors which each fasten directly to both layers of ribbed panels and extend through ribs of the second layer of panels and extend through the first layer of panels at locations between adjacent ribs of the first layer of panels.

27. A roof system for a building structure including spaced-apart elongate roof support purlins which comprises a first layer of elongate contiguous ribbed roof panels having elongate upstanding ribs and being connected in side-by-side and end-to-end adjacency positioned in an overlying relationship to the purlins of the building structure, means for connecting the first layer of ribbed roof panels to the building structure with the ribs extending generally transversely to the purlins; a second layer of contiguous interconnected ribbed roof panels having elongate upstanding ribs and being connected in side-by-side and end-to-end adjacency positioned above the first layer of ribbed roof panels with one or more of the ribs of the second layer of panels generally vertically aligned with one or more of the ribs of the first layer of ribbed panels, and means for connecting the second layer of ribbed panels to the first layer of ribbed panels in substantially continuous spaced-apart relation including a plurality of U-shaped clips spaced apart from one another, each U-shaped clip having a pair of upstanding legs supported upon the first layer of panels and a middle portion which is directly connected to and spans each upstanding leg and spans at least one rib of the first layer of panels and supportably receives the second layer of panels.

* * * * *